US005439225A

United States Patent [19]

Gvoich et al.

[11] Patent Number: 5,439,225

[45] Date of Patent: Aug. 8, 1995

[54] SWING TRAINING AND EXERCISE DEVICE

[75] Inventors: Ned Gvoich, Beamsville, Canada; Andreas Belalcazar, Bogota, Colombia

[73] Assignee: Kordun, Ltd., Studio City, Calif.

[21] Appl. No.: 242,550

[22] Filed: May 13, 1994

Related U.S. Application Data

[63] Continuation-in-part of Ser. No. 30,628, May 13, 1993, Pat. No. 5,312,107.

[51] Int. Cl.[6] ..... A63B 21/24; A63B 21/22; A63B 69/36

[52] U.S. Cl. ..... 273/186.1; 482/8; 482/112; 482/118; 482/902; 273/191 A; 73/379.09

[58] Field of Search ..... 273/186.1, 191 R, 191 A, 273/191 B, 192; 482/5, 6, 7, 109, 111, 112, 113, 118, 119, 146, 147, 902; 73/379.09

[56] References Cited

U.S. PATENT DOCUMENTS 5,312,107 5/1994 Gvoich et al. ..... 273/186.1

*Primary Examiner*—George J. Marlo
*Attorney, Agent, or Firm*—Michael Sand Co.

[57] ABSTRACT

An exercise device adapted for use by a person, comprising:

a first ring having a predetermined diameter, an inner surface, and an outer surface;

a second ring concentric to the first ring and rotatably retained by the first ring;

and components for providing isokinetic resistance to rotation of the second ring and for sensing predetermined characteristics of said second ring during rotation and providing sensor signals corresponding to said sensed characteristics;

whereby a person applying a torque in a first direction of rotation causes rotation of the second ring in the first direction of rotation against the isokinetic resistance and the sensing components in response to said rotation sense said predetermined characteristics which are subsequently converted into sensor signals.

12 Claims, 24 Drawing Sheets

50
80
40
112
114
116
118
120
121
122
124
125
126
128
129
131
133
135
140
141
142
144
145
146
150
151
152
153
154
160
161
162
163
164
165
166
168
170
172
174
176
200
330
332
334
336
338
340
342
344
346
348
350
352
360
362
364
366
368
370
372
374
376
378
379
380
382
384
386
388
390
392
430
432

SWING TRAINING AND EXERCISE DEVICE

This is a continuation-in-part of application Ser. No. 08/030,628, filed on May 13, 1993, now U.S. Pat. No. 5,312,107.

BACKGROUND OF THE INVENTION

1. Field Of The Invention

The present invention relates to a swing training and muscle exercising device which assists the user in developing a full range of motion swing enabling the user to consistently and efficiently transfer power at the instant of contacting a stationary object, such as a golf club to a golf ball. Persistent usage of the device can strengthen the muscles used in the swing and also reinforce myoneural "muscle memory." Although the principles of the invention can be adapted to other sports or activities where a swinging motion is employed, the preferred embodiment is adapted for use as a golf swing training device. Consequently, the preferred embodiment of the invention described herein is directed to a golf swing training and exercising device.

The optimum golf swing provides for maximum distance and accuracy of the golf shot. This is achieved when the golf swing maintains an appropriate swing plane along a determinable inside and outside swing path (inside of the parallel plane of a line directed through the golf ball to the target). The body's muscles create, store and release energy squarely to a golf ball. The physiological components of the optimum golf swing include physical agility, flexibility, strength, power, muscular endurance, balance, coordination, leverage through good posture and hand-to-eye coordination. When all of these physical attributes are integrated with the optimum golf swing mechanics, maximum club head speed and transference of energy to a golf ball is realized.

The optimum golf swing is a fluid timed motion which optimizes power, coordination and speed of a user's swing to deliver an impact to the ball to achieve desired distance and accuracy. This motion is linked through eight critical phases of movement.

Executing an ideal, total, full-range of motion golf swing entails performing complex combinations of separate motions, or portions, during eight sequential phases: (1) the set-up phase, (2) the takeaway phase, (3) the top of the swing phase, (4) the downswing phase, (5) the hitting zone phase, (6) the impact phase, (7) the release phase, and (8) the follow-through phase.

1. The Set-Up Phase

The first phase, the set-up phase, is the initial stance the golfer takes to strike the ball as illustrated in FIG. 18. An effective set-up requires balance and effective posture to set the trunk and limbs of the body in the most mechanically advantageous position with the body weight slightly favoring the left foot in the right to left golf swing. In the set-up phase, the golfer aligns the club head with the ball and a pre-selected target as illustrated by the imaginary line 113 in FIG. 18. Imaginary line 113 defines two regions. The first region is the side of the line on which the golfer stands facing the ball. This first region is referred to as the "inside," and the region on the opposite side of line 113 is referred to as the "outside." Thus, when a golfer's swing is described as an "inside to outside" swing, the club head travels in a path, termed the "swing path," from the inside region before impact with the ball, to impact with the ball at line 113, and then in a path in the outside region after impact.

2. The Takeaway Phase Or Backswing

In the second phase, the takeaway phase, as illustrated in FIG. 19, the golfer shifts the body weight to favor the right foot and initiates the backswing with the large muscles of the legs and trunk. A triangle formed by the position of shoulders and hands allows the golfer to perform a one-piece takeaway, drawing the club back along the appropriate swing plane to match the selected golf club and along a determinable inside-to-outside or outside-to-inside swing path. The swing plane(s) are illustrated in FIG. 15 as the planes in which the golfer's hands move 560 and the plane in which the club head moves 570 comprising two parallel planes. The swing plane is dependent upon the individual anatomical variants of the golfer and the selected club length. The taller golfer will stand closer to the ball and therefore have a steeper swing plane. The shorter club will also require the golfer to stand closer to the ball and thereby require a steeper swing plane as illustrated in FIG. 15, the angle $\propto$ between the planes 560 and 570 with the horizontal become larger as the swing planes 560 and 570 become more upright.

3. The Swing Phase

In the third phase of the swing, the top of the swing phase, the club is posted with the club shaft approximately parallel to the ground, as seen in FIG. 20, and the club head pointing back directly at the target. The left arm remains relatively straight and the right arm is folded at the elbow. The back forearm is supinated, i.e., rotated counterclockwise for a right-handed golfer or rotated clockwise for a left-handed golfer, and the front forearm is pronated, i.e., rotated clockwise for a right-handed golfer or rotated counterclockwise for a left-handed golfer. In the right-handed golfer, the right wrist is cocked back in extension. The golfer's body coils wherein the shoulders have turned back more than twice as much as the hips which are turned back more than twice as much as the knees. The body has been wound from the top down with the upper body turned back against the resistance of the lower body and poised to enter phase four, the downswing phase.

4. The Downswing Phase

In the downswing phase, the club is pulled into action by the uncoiling of the large muscles of the body. It is the timely unwinding of the downswing phase, while maintaining the appropriate swing plane and predetermined swing path, that produces the optimum golf swing. Pulling the club out of the swing path alters the angle at which the club head meets the ball and thereby alters the flight path of the ball. It is therefore important for a golfer to develop a consistent swing path within a consistent swing plane to achieve optimum results. A further problem that occurs during the downswing phase is referred to as casting of the club, wherein the angle formed between the club and the two arms is drastically increased. Casting the club results in a deviation from the swing plane and adversely affects both the power and speed of the club producing a weak shot.

5. The Hitting Zone Phase

In the fifth phase, the hitting zone phase, as seen in FIG. 22, the golfer attempts to get the hands as close as possible to being in-line directly above the ball while still maintaining the angle $\beta$ formed at set-up between the club shaft and the arms, the right wrist remains cocked and the back arm remains folded so that the stored energy of the swing is maintained until impact with the ball to ensure maximum energy transference from the club head to the ball.

6. The Impact Phase

In the sixth phase, the impact phase, as seen in FIG. 23, the club head is accelerated by a whipping action created by the straightening of the right arm, pronation of the right forearm and uncocking of the right wrist in a timely manner at a fixed point corresponding to the impact with the ball.

7. The Release Phase

In phase seven, the release phase, the right hand has turned over the left hand so that the club points toward the target. This ensures complete expenditure of the energy.

8. The Follow-Through Phase

In phase eight, the follow-through phase, the arms, trunk and body continue, by momentum, in the swing plane and path to complete the effective golf swing.

The optimal golf swing training device should have the ability to activate and train the trainable physiological components of the swing since they are inseparable and co-dependent. Sports-specific flexibility training is accomplished by the full range of motion movements comprising the physical task. Strength and power training requires exercise against a resistance, while muscular endurance requires repetition of the activity. Good balance is developed through repetitive proprioceptive training movements. Improved leverage is developed when the golfer adopts an effective sports-specific posture. Hand-to-eye coordination is improved by focused concentration and repetitive accomplishment of the task. Agility and coordination result from the integration of all the physiologic components of the movement.

2. Description Of The Related Art

Many attempts have been made to provide golf swing training and/or exercising devices to assist the golfer in developing an effective golf swing and in the strengthening of the muscles attuned to the golf swing. Known golf swing training and/or exercising devices implement restrictive control of the golfer's body movement, restrictive control of the golf club or restrictive control of a handle attachment in place of the golfer's club and/or combinations thereof. Since the golf swing is an individually varying movement, the restrictive control of the golfer, the golf club or a handle attachment is not a desirable feature.

U.S. Pat. No. 5,050,874 to Fitch attempts to achieve both objectives in a device where a user executes a simulated golf swing by rotating a parabolic-shaped arm against a spring-loaded resistance mechanism which offers minimum resistance when the swing motion is in the proper plane. However, this device has major inadequacies whose significance will be evident from the foregoing discussion, and which may be summarized as follows: restricting the swing to only a portion of a realistic full-range of motion golf swing; not providing means of visualizing the relationship of a club, from grip to club head, to the ball; pulling the user back into the top of the swing instead of allowing proper torsion of the shoulders, upper torso and hips; not adjusting for clubs of different length; not providing means to adjust swing plane and/or swing path; not providing means for delivering resistance to the large muscles of the trunk and legs for unwinding torsion in the upper body from the top down; not providing means of altering swing resistance at any point in the swing or throughout the full range of motion; and not providing indication of power, force or speed achieved during the various phases of a swing.

Another device which attempts to combine golf swing training with strengthening muscles used in the swing is U.S. Pat. No. 3,614,108 to Garten. The user swings a simulated golf club handle pivotally attached to an arm rotatably connected to a wall-mounted plate having adjustable inclination and adjustable frictional resistance, the arm rotating about an axis normal to the plate. In addition to having all the inadequacies of the Fitch device, the Garten device constrains the swing path to a circular arc rather than an eccentric arc as required for an ideal golf swing, and unrealistically generates resistance during the takeaway phase of the swing.

Yet another device which attempts to combine golf swing training with muscle strengthening is manufactured by Perfect Swing Trainer, Inc. of Orlando, Fla. A user swings a golf club while standing within a stationary planar ring. The ring is adjusted in inclination so as to match the inclination of the user's swing plane, and is adjusted in height so that the lowermost portion of the ring matches the club's "balance point" i.e., its center of mass. The user must maintain continuous contact between the club shaft and the ring during both the takeaway and the downswing. The club head is thereby constrained to move in a plane parallel to and near the ring plane. Optionally, an elastomeric cord may be attached between a point on the ring to one or the other of the user's hands. The particular hand and point of ring attachment determine which shoulder and arm muscles can be exercised during which segment of the swing.

Inadequacies of the Perfect Swing TM device include: The inability to set a proper swing path, failure to provide a resistance through the full range of motion, and failure to provide feedback to the golfer with respect to the exercise function of the device.

U.S. Pat. No. 3,926,430 to Good, Jr. is directed to a device for exercising the principal sets of muscles used to play golf against a resistance force, while moving the muscles to simulate the manner in which they are moved during an actual golf swing. This device avoids the deficiencies of friction-type resistance units, viz., unpredictable jerkiness, maximum rather than minimum resistance at the beginning of a swing motion, and difficulty in accurately adjusting the resistance force during and throughout the swing motion, by incorporating a hydraulic torque resistance unit. A user manipulates a handle connected to a rotatable shaft extending axially from a hydraulic chamber which generates a progressively and smoothly increasing resistance torque as the rotational speed of the shaft increases. However, this device unrealistically delivers resistance in both directions of the golf swing, and does not train the swing, serving solely as an exercise device.

Other devices limited to training a golf swing are disclosed in: U.S. Pat. No. 4,486,020 to Kane et al.; U.S. Pat. No. 4,758,000 to Cox; U.S. Pat. No. 4,261,573 to Richards; U.S. Pat. No. 3,415,523 to Boldt; U.S. Pat. No. 3,319,963 to Cockburn; U.S. Pat. No. 2,626,151 to Jenks; U.S. Pat. No. 2,318,408 to Beil et al.; and U.S. Pat. No. 1,983,920 to Perin.

In view of the limitations of the above-cited devices, there has been a need for a device and/or technique whereby a user, whether he or she is a novice golfer, an intermediate golfer or an advanced golfer, can train the skills required for an effective golf swing. These skills include the grooving of the full range of motion swing plane and swing path and the timed linking of the eight phases of the golf swing to thereby deliver the maximum power at the point of impact of the club head with the ball, more commonly referred to as the swing tempo. Furthermore, there has been a need for a device that is sports-specific wherein the golfer utilizes his own clubs and actually strikes a ball. There has also been a need for a device that can exercise and thereby strengthen the muscles required to execute the golf swing and improve coordination and balance physiology of the golfer. There has also been a need for a device that provides a feedback to the golfer relating to his or her golf swing performance, thereby further enhancing learning.

OBJECTS OF THE INVENTION

Accordingly, it is an object of the present invention to provide a device which trains a user to sequentially execute during a full-range of motion golf swing, movements of the feet, legs, hips, trunk, shoulders, arms and hands, in tempo and rhythm, which result in optimum club head speed and clubface-to-ball alignment at the instant of impact.

A further object of the invention is to provide a device which enables a user to swing a golf club within a predetermined swing plane which is adjustable so as to accommodate differences in physiological characteristics, swing style, address posture, and club length.

Yet another object of the invention is to provide a device which enables a user to perform a full-range of motion golf swing without encountering mechanical limitations and/or without visually obstructing the club head.

A further object of the invention is to provide a device which enables a user to execute a full-range of motion golf swing wherein the club head traverses an optimum, non-circular swing path within a predetermined swing plane, so as to impact a ball pre-positioned with respect to the user, as during actual play on a golf course.

A still further object of the invention is to provide a device which enables a user to adjust a swing path with respect to a predetermined target line so as to achieve at impact a "fade," a shot directly along the target line, or a "draw".

Another object of the invention is to provide a device which enables tailoring a full-range of motion swing for each of a user's wood and iron golf clubs.

Yet another object of the invention is to provide a device which enables a user to exercise the muscles used in executing a full-range of motion sport swing.

A further object of the invention is to provide a device which provides automatically accommodating resistance during a downswing as a user applies increasing force, thereby training the muscles used during the swing by reinforcing the corresponding neurological pathways.

Another object of the invention is to provide a means of adjusting and controlling movement speed through the complete range of motion for training golf-specific muscles to develop strength, power and endurance.

Yet a further object of the invention is to train a user to execute an inside-to-outside swing path during both the takeaway and downswing phases, so as to distribute biomechanical stresses evenly throughout the spinal segments.

Still another object of the invention is to provide feedback information from which a user can determine how effectively each swing phase was performed, and how well the separate phases melded into a total swing pattern.

Another object of the invention is to provide a device that is simple, reliable, easy to use, and easy to maintain.

One more object of the invention is to provide a device that is relatively simple and inexpensive to manufacture.

Other objects of the invention will become evident when the following description is considered with the accompanying drawings.

SUMMARY OF THE INVENTION

The present invention overcomes inadequacies of conventional golf swing training and exercising techniques and/or devices by providing a device that enables a user to execute a normal, full range of motion golf swing at an appropriate pre-selected movement velocity. If the user attempts to increase the velocity of the rotating ring beyond the selected value, the mechanism effectively resists this change and provides resistance to the swing equal to the applied force so that swing velocity remains constant. In this way, the user automatically controls the intensity of the exercise, by adjusting the force he or she applies to the rotating ring, to a level that is suited to his or her fitness level. As the user's strength increases, he or she can increase the force applied to the rotating ring and its resistance system and thereby increase the training effect. Furthermore, because the resistance automatically accommodates to the user's strength throughout the full range of motion of the swing, the training effects are optimized at all joint and body positions, i.e., resistance profiles the user's "strength curve."

An additional feature of the current invention is its sports-specific design. Exercise physiologists and biomechanists for many years have endorsed the concept of optimal training benefits while training on equipment that accurately simulates the sporting activity. The current design allows the user to perform a normal golf swing while allowing unobtrusive guiding of the user's club and body movements and provides optimum training resistance throughout the complete range of motion of the swing.

The device includes adjustments enabling the user to execute a full range of motion swing with any of his or her clubs in a selectable swing plane and swing path tailored to his or her physiological characteristics, stance when addressing the ball, and preference for fading a shot, hitting the ball along the target line, or drawing the shot. The adjustments enable the club head to be moving in a swing path and swing plane such that the club head will impact the ball pre-positioned as for an actual golf shot.

The device also measures and displays the force generated by the user (via the club) at selected intervals during travel along the swing path, including downswing phase, hitting zone phase and at impact phase. These discrete force measurements are calibrated and stored electronically and provide an accurate profile of the user's strength throughout each golf swing. Furthermore, by determining the time taken to travel each interval and knowing the relative angular distance for each interval on the rotating ring, the angular velocity and angular acceleration can be computed, stored and displayed electronically. From these measurements, other significant data such as applied torque, power and work can easily be derived, stored and displayed. The stored data can be accumulated and used to track the calories expended, strength during each interval along the swing path, strength during ball impact, and consistency of effort during successive swings. From the display of these measurements, the user can gauge his or her progress in achieving proper body coordination, tempo, rhythm, power and, through repetition, the swing is neurologically grooved and the muscles are strengthened. The display of these measurements permits the user to compare the attributes of his or her golf swing to those of the professional golfer, thereby establishing a training objective to accomplish. The user may also use the display of these measurements as an indication of their exercise levels while on the golf course or at the driving range.

In more detail, a preferred embodiment of the present invention comprises a base sub-assembly including: a circular platform frame having a circumferential tubular member; a circular platform cover having a downwardly extending outer edge forming an annular lip, the cover diameter such that the lip snaps over or otherwise closely receives the circumferential tubular member; and generally vertical, diametrically opposite, first and second stanchion brackets, each rigidly attached at a lower portion to the circumferential tubular member.

The preferred embodiment further comprises a generally vertical first (or lower) stanchion sub-assembly including: a first arcuate member rigidly attached to the first bracket, a second arcuate member closely received by and slidable with respect to the first tubular member and having a slotted upper portion, and a locking pin for fixing the position of the second tubular member relative to the first tubular member; a transversely compressible, bifurcated first (or lower) clamp closely received and pivotable within the slotted upper portion of the second tubular member; a first (or lower) axle having a lower portion and an upper end, the lower portion closely received within the lower clamp and axially rotatable when the clamp is not under transverse compression; and a locking bolt for fixing the angle of pivot of the lower clamp with respect to the slotted upper portion of the second tubular member, and fixing the axial disposition of the lower axle relative to the lower clamp.

The preferred embodiment further comprises a ring sub-assembly including: a stationary ring-shaped angle member having first and second mutually orthogonal flanges, the upper end of the lower axle rigidly attached to the second flange; and a circular tubular member closely received by, and in the absence of an external frictional force, freely rotatable within a right-angle recess formed by the first and second flanges. The rotatable tubular member is retained within the recess by a plurality of retainer clips.

The preferred embodiment further comprises a club-holder sub-assembly including first and second lath-shaped frame members each having a first end rigidly connected to the rotatable arcuate member, and a second end rigidly attached to a housing with a longitudinal bore. The frame members are symmetrically disposed so as to constitute two legs of a triangle with the housing at its apex, the plane of the triangle being offset at an angle of about 20 degrees from the plane of the ring sub-assembly. A shaft having a swivel connector at a distal end is slidably disposed within the housing. A "U"-shaped member including a base and first and second legs is connected at the base to the swivel connector. A cross-piece member is transverse to and slidably disposed upon the legs of the U-shaped member, so as to determine a bounded planar opening. The U-shaped member and cross-piece member thus comprise a retainer for a club shaft. A golf club having a stop member rigidly connected at a selectable position along the club shaft is disposed so that the shaft passes through the retainer opening with the stop member on the distal side of the opening. The cross-sectional area of the stop member is larger than the area of the planar opening. The slidable shaft and the club shaft stop member are adjustably positioned so that when the user "posts" the club at the top of the swing, the stop member contacts the club shaft retainer. Thus, as the user begins the downswing, torque generated in the club shaft is transmitted by frictional contact between the stop member and the club shaft retainer via the frame members to the rotatable arcuate member, resulting in a rotation of the arcuate member within and relative to the stationary ring-shaped member. The club shaft is disposed neither in the plane of the ring sub-assembly nor in the plane of the club holder sub-assembly. However, when the arcuate member rotates, the club head is constrained to move along a path in a plane which is substantially parallel both to the ring sub-assembly plane and to a plane in which the distal end of the shaft moves. Thus, the club head moves in a swing path substantially in a plane that is parallel to but offset from the ring plane so that the club head can contact a ball pre-positioned at address.

The preferred embodiment further comprises a generally vertical second (or upper) stanchion sub-assembly including: a tubular member rigidly attached at a lower end to the second bracket, and having a slotted upper portion; an elongated member of a predetermined length, disposed generally transverse to the tubular member, and having a longitudinally disposed slot extending over about two-thirds of the length, and having a longitudinal notch at an end proximal to the ring sub-assembly; a transversely compressible, bifurcated second (or upper) clamp closely received and pivotable within the proximal notch; a second (or upper) axle having an upper portion and a lower end, the upper portion closely received within the upper clamp and axially rotatable when the clamp is not under transverse compression; a first locking bolt for fixing the angle of pivot of the upper clamp and fixing the axial disposition of the upper axle; and a rectangular box-shaped housing rigidly attached to the stationary ring-shaped angle member by first and second mounting brackets. The lower end of the upper axle is rigidly attached to the box-shaped housing at a position diametrically opposite to the attachment position of the upper end of the lower axle. The elongated member is disposed in a generally vertical plane within the slotted upper portion of the tubular member, and is constrained to slide relative to and/or pivot about a second locking bolt passing through the longitudinal slot.

The preferred embodiment further comprises a hydraulic resistance sub-assembly including: a hydraulic pump mounted within the housing; a drive-shaft connected to a drive-gear of the pump; a one-way clutch rotatably attached to the drive-shaft; a governor wheel; a rigid conduit for hydraulic fluid connecting the outlet and inlet ports of the gear pump so as to comprise a closed system; a flow restricting valve within the rigid conduit connected between the inlet port and the outlet port; a pressure sensor including a pressure transducer; and a flexible conduit filled with hydraulic fluid connected to the transducer.

In the current invention, the user generates a tangential force on the rotating ring which causes the ring to rotate. This ring is directly coupled to the input shaft of the hydraulic pump. Therefore, as the ring rotates, the input shaft of the pump will also rotate and force fluid to flow within the pump.

The rate at which hydraulic fluid can flow within this closed system is regulated by the size of the aperture of the flow-restricting valve. Since the rate of hydraulic flow regulates the speed at which the pump shaft rotates, it follows that the aperture size will govern pump speed and hence rotating ring speed.

When the valve aperture is closed, hydraulic fluid cannot flow in the system and pump speed will be zero. If the user applies a force to the rotating ring, which drives the pump, no movement will occur. However, pressure will increase within the pump in direct proportion to the magnitude of the applied force. Small valve apertures will allow relatively low pump speeds. Conversely, large valve apertures will result in high pump speeds. As the user attempts to increase the speed of the rotating ring beyond the speed set on the aperture valve, the pump will resist this speed increase and pressure will increase within the pump. It is this resistance to speed change that provides the isokinetic training benefits detailed previously. Monitoring the increase in pressure within the pump provides the user with quantitative information on the forces he or she is generating.

The preferred embodiment further comprises an electronic monitoring sub-assembly which includes: a user interface circuit; a displacement sensor for measuring the relative travel of the rotatable ring along the swing path; a digital computer responsive to signals from the user interface, the displacement sensor and the pressure sensor to function as a monitoring controller of exercise on the device; and a direct current (dc) power source for the pressure sensor, user interface circuit, displacement sensor, and monitoring controller. The pressure sensor includes a signal processing circuit which amplifies and buffers the electrical signals generated by the pressure transducer. At selected instances during the downswing the displacement sensor sends a signal to indicate the distance traveled along the swing path to the monitoring controller. In response to the displacement sensor, the controller measures the signal representing the force value at that point in the downswing from the pressure sensor for recordal and display.

The user interface includes a power on/off switch, a controller interface switch, and a display panel. The monitoring controllers include a Central Processing Unit (CPU) having a read only memory (ROM) a random access memory (RAM) and a computer program stored in the ROM, an analog to digital (A/D) convertor connected to the pressure sensor, and a data bus connecting the CPU with the display panel and A/D convertor. The monitoring controller connects in circuit to the user interface switches and the displacement sensor. The computer program enables the CPU to monitor the displacement sensor for travel signals. Upon receiving a signal, the CPU enables the A/D convertor to send pressure data digitally converted from the pressure sensor through the data bus. The pressure data is stored in RAM processed, and subsequently transmitted to the display panel from the CPU through the data bus.

During a downswing, data from the displacement sensor and pressure sensor are continuously monitored by the CPU. Those skilled in the art will appreciate the computer program can be programmed to, upon receipt of the data, process the data for display of exercise goals and comparisons. For example, those users wishing to use the device primarily for exercise and stress release may want to track calories used and time expended on the machine. Other avid golfers can use the device to track the strength consistency of their golf swing along the down swing path. Others can track cumulative progression or average work when using the device, perhaps through several sessions of operation.

A more complete understanding of the present invention and other objects, aspects and advantages thereof will be gained from a consideration of the following description of the preferred embodiment read in conjunction with the accompanying drawings provided herein.

DESCRIPTION OF THE PREFERRED EMBODIMENT

I. INTRODUCTION

Figure 1:
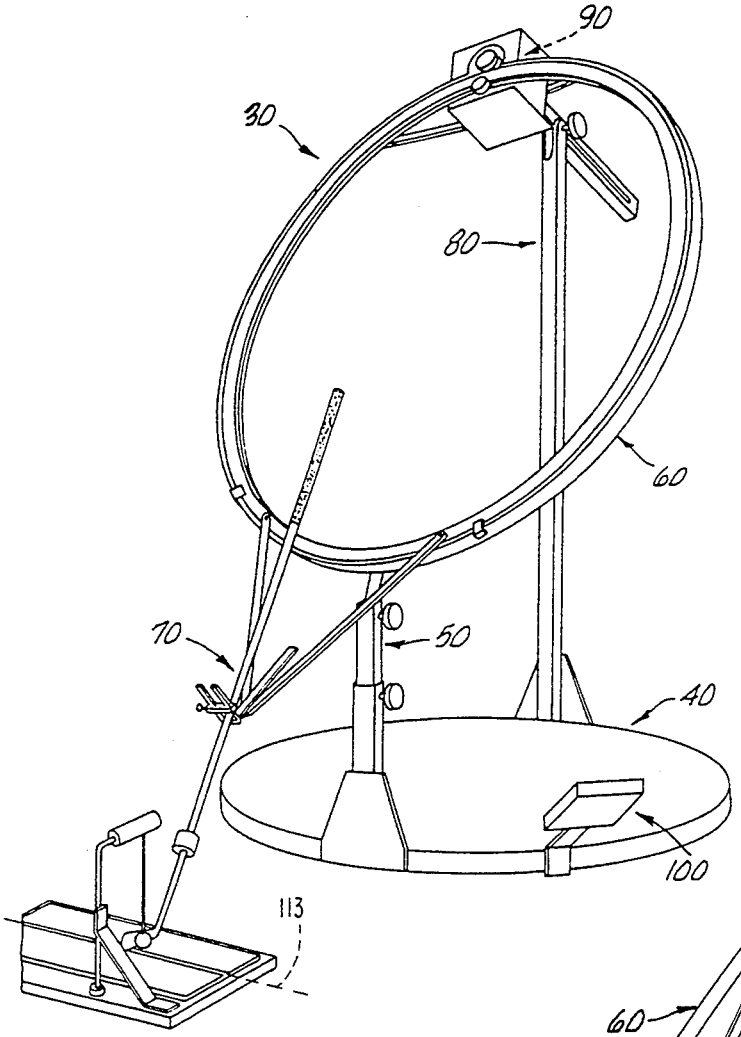
FIG. 1 is a perspective view of a preferred 5 embodiment of the present invention adapted for use as a golf swing training device.
Figure 2:
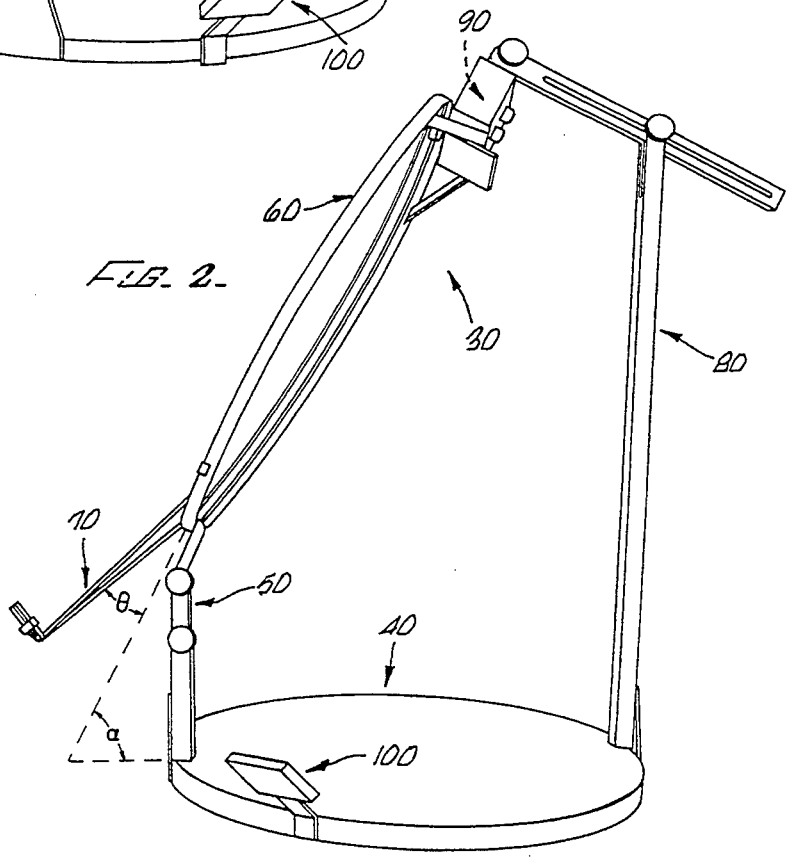
FIG. 2 is a side elevational view of the FIG. 1 embodiment.
Figure 3:
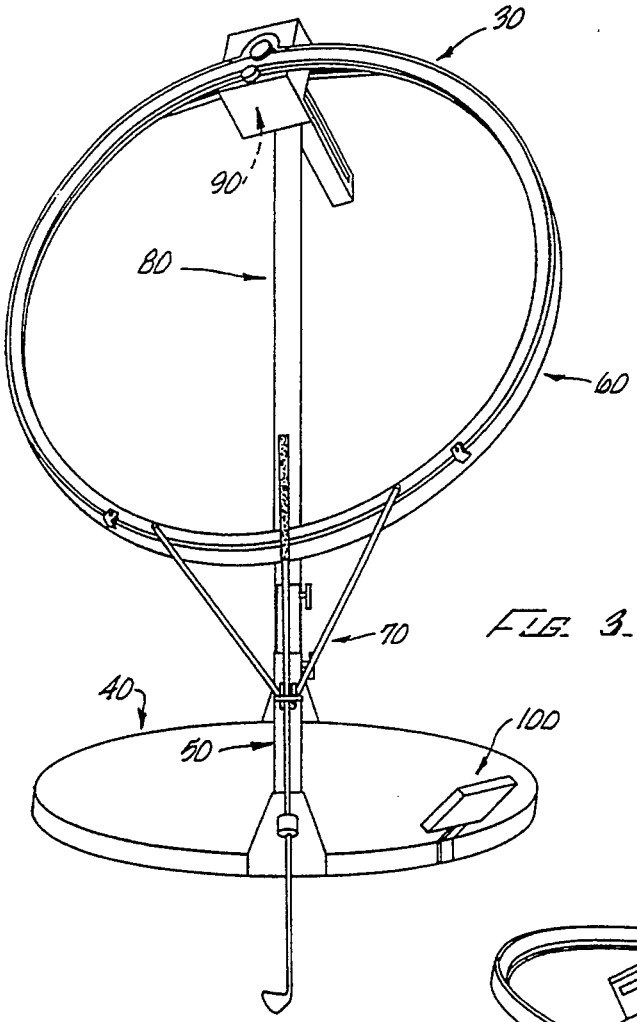
FIG. 3 is a front elevational view of the FIG. 1 embodiment.
Figure 4:
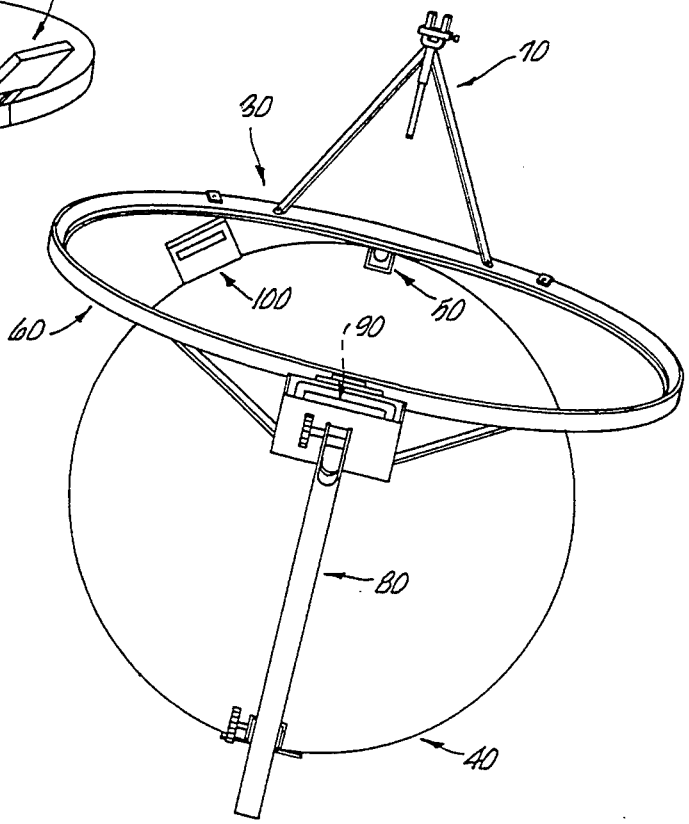
FIG. 4 is a top plan view of the FIG. 1 embodiment.

While the present invention is open to various modifications and alternative constructions, the preferred embodiment shown in the drawings will be described herein in detail. It is to be understood, however, there is no intention to limit the invention to the particular form disclosed. On the contrary, it is intended that the invention cover all modifications, equivalences and alternative constructions falling within the spirit and scope of the invention as expressed in the appended claims.

II. COMPLETE ASSEMBLY AND SUB-ASSEMBLIES

A. Complete Assembly

As shown in FIGS. 1–4, a swing training and muscle exercising device 30 includes a generally horizontal base sub-assembly 40, a generally vertical first (or lower) stanchion sub-assembly 50, a planar ring sub-assembly 60, a club-holder sub-assembly 70, a generally vertical second (or upper) stanchion sub-assembly 80, a hydraulic resistance sub-assembly 90, and an electronic monitoring sub-assembly 100.

B. Base Sub-Assembly

Figures 5, 8:
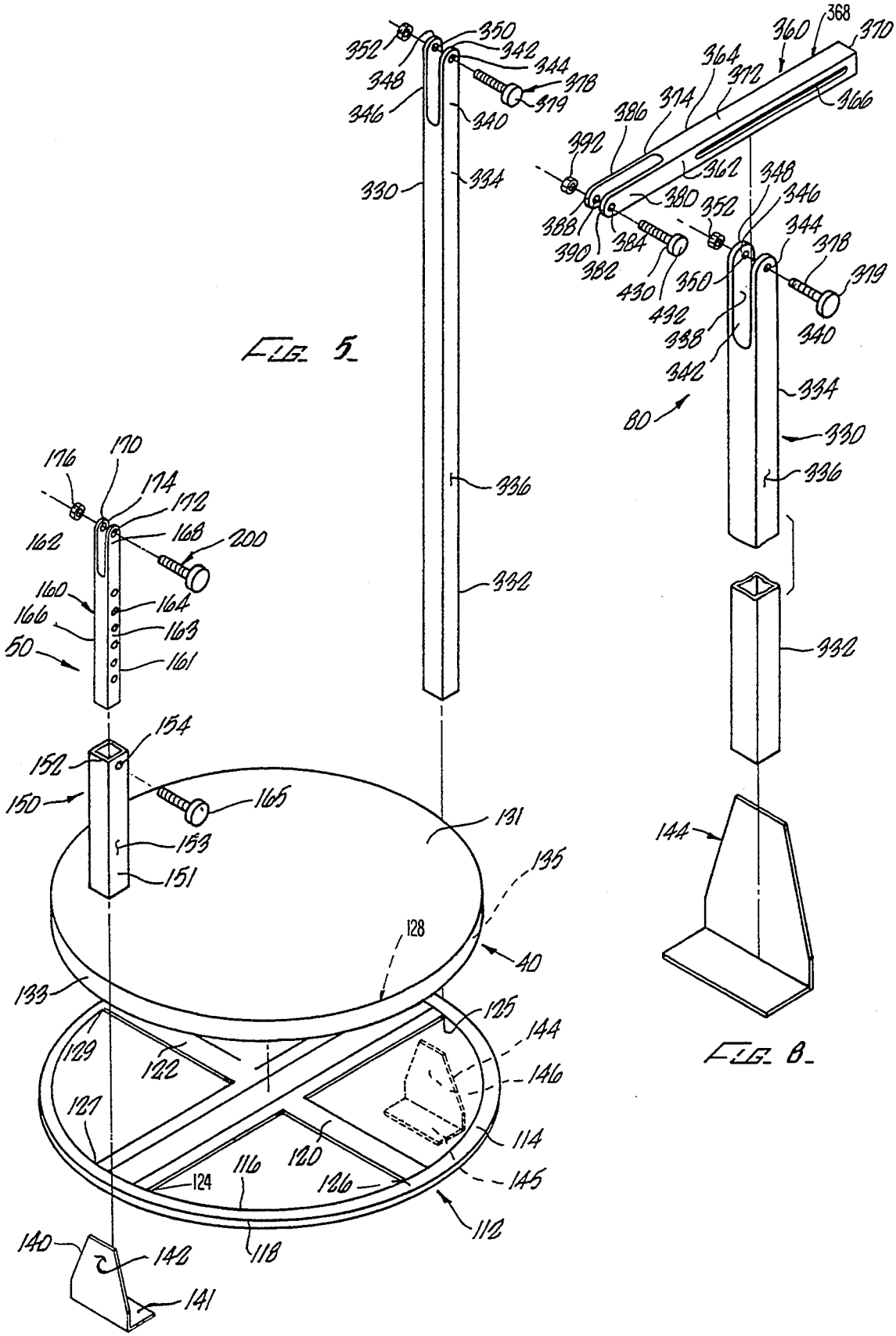
FIG. 5 is an exploded perspective view of a base, a base cover, first and second stanchion brackets, a fixed member of a lower stanchion, a slidable member of the lower stanchion, and a fixed member of an upper stanchion, of the FIG. 1 embodiment.
FIG. 8 is an exploded perspective view of the FIG. 5 second stanchion bracket and fixed member of the upper stanchion, and an elongated slidable, pivotable member.

Referring to FIG. 5, the base sub-assembly 40 includes a circular platform frame 112 having a circumferential member 114 with an inner surface 116 and an outer surface 118. First and second "T"-shaped brace members 120 and 122, having, respectively, a first, second, and third end 124, 125, 126, and 127, 128, 129, are rigidly attached at the ends 124, 125, 126 and 127, 128, 129, to the inner surface 116 of the circumferential member 114. In the preferred embodiment, the circumferential member is formed from a one-inch diameter round tube. Circumferential member 114 is about 42 inches in diameter. A generally circular platform cover 131 has a downwardly extending outer edge 133 forming an annular lip 135. The lip 135 snaps over or is otherwise closely received by the circumferential member 114.

As further shown in FIG. 5, a generally vertical first stanchion bracket 140 having a lower portion 141 and an upper portion 142 is rigidly attached at the lower portion 141 to the circumferential member 114. A generally vertical second stanchion bracket 144 having a lower portion 145 and an upper portion 146 is rigidly attached to the circumferential member 114 at a position diametrically opposite to the position of attachment of the bracket 140.

The base sub-assembly may be of other configurations and dimensions, so long as it performs the function of providing a stable base for the stanchion sub-assemblies. In some applications, the ground itself, or a floor, may function as the base.

C. First Stanchion Sub-Assembly

Figures 6, 7, 11:
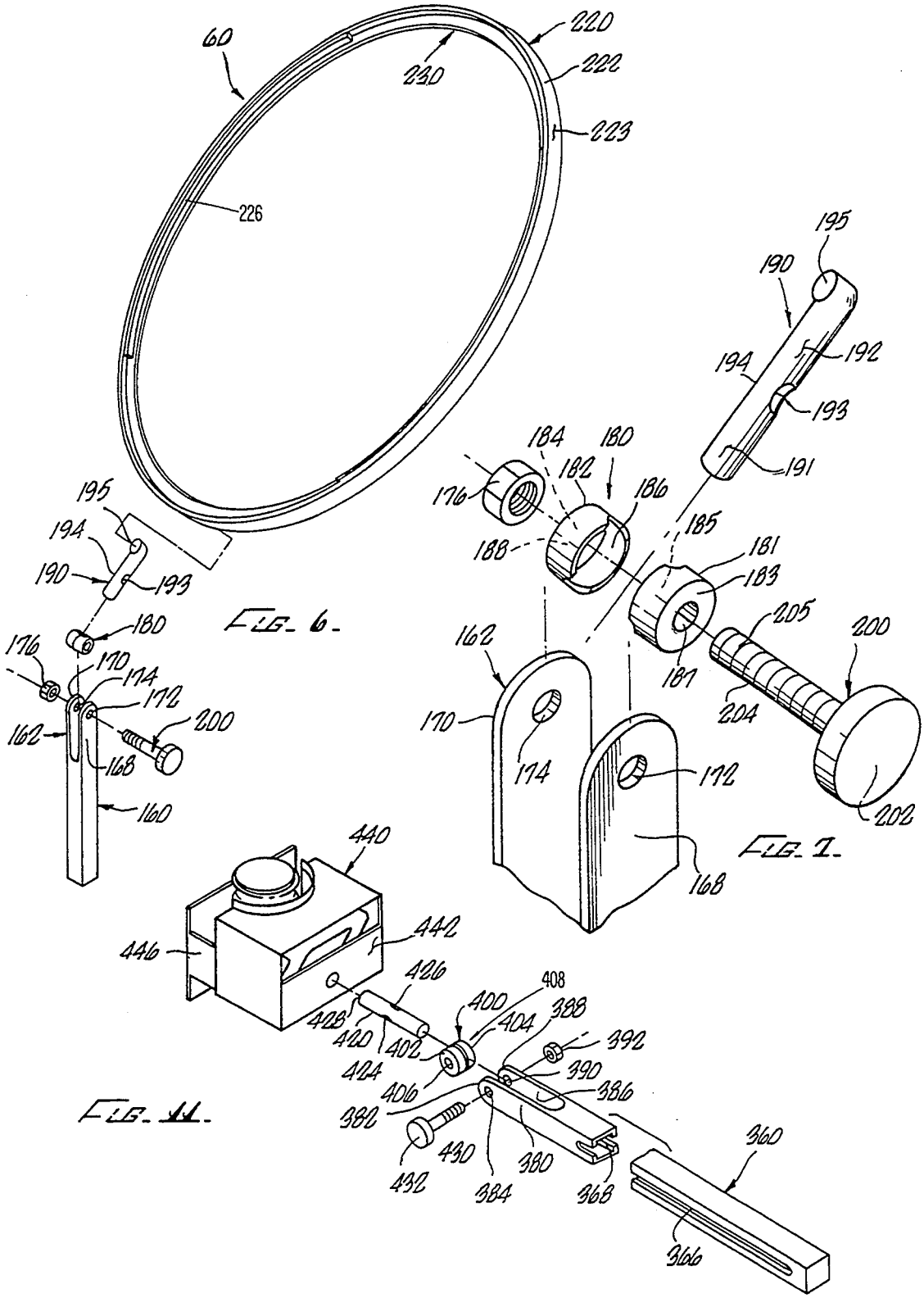
FIG. 6 is an exploded perspective view of the FIG. 5 slidable member, a lower axle, a lower clamp, a locking bolt, and a ring-shaped angle member of a ring sub-assembly.
FIG. 7 is an exploded perspective view of the FIG. 5 slidable member and the FIG. 6 lower axle, lower clamp, and locking bolt.
FIG. 11 is an exploded perspective view of the FIG. 8 elongated member, the FIG. 10 housing, upper axle and upper clamp, and a locking bolt.

As shown in FIGS. 5, 6 and 7, the first, or lower stanchion sub-assembly 50 includes a first support member 150 having a lower portion 151, an upper portion 152, and a generally vertical side 153, the lower portion 151 rigidly attached to the first stanchion bracket 140, and the side 153 including a hole 154. As shown in FIG. 5, the lower stanchion sub-assembly 50 further includes a second tubular member 160 having a lower portion 161, a slotted upper portion 162, and a generally vertical side 163. The side 163 has a plurality of evenly spaced holes 164. The member 160 is closely received by and slidably disposed within the member 150, the side 153 parallel to the side 163. As discussed in Section III, infra, when adjusting the height of the device 30 to conform to a user's physiological characteristics, the member 160 is positioned within the member 150 so that the hole 154 coincides with one of the holes 164. A locking pin 165 inserted through the holes 154 and 164 rigidly maintains the relative position of the members 150 and 160. In this way, the vertical position of a point on the ring sub-assembly is fixed.

Alternatively, and not shown in the Figures, the side 163 and a parallel side 166 of the member 160 may include generally vertical, parallel first and second slots. The position of the member 160 within the member 150 is maintained by tightening a locking bolt passing through the hole 154 and the first and second slots.

Referring to FIGS. 5 and 7, the upper portion 162 of the second tubular member 160 includes parallel, resilient first and second projections 168 and 170, the projection 168 extending upwardly from the side 163, and including a hole 172. The projection 170 includes a hole 174 and a threaded receptacle or nut 176.

Figure 17:
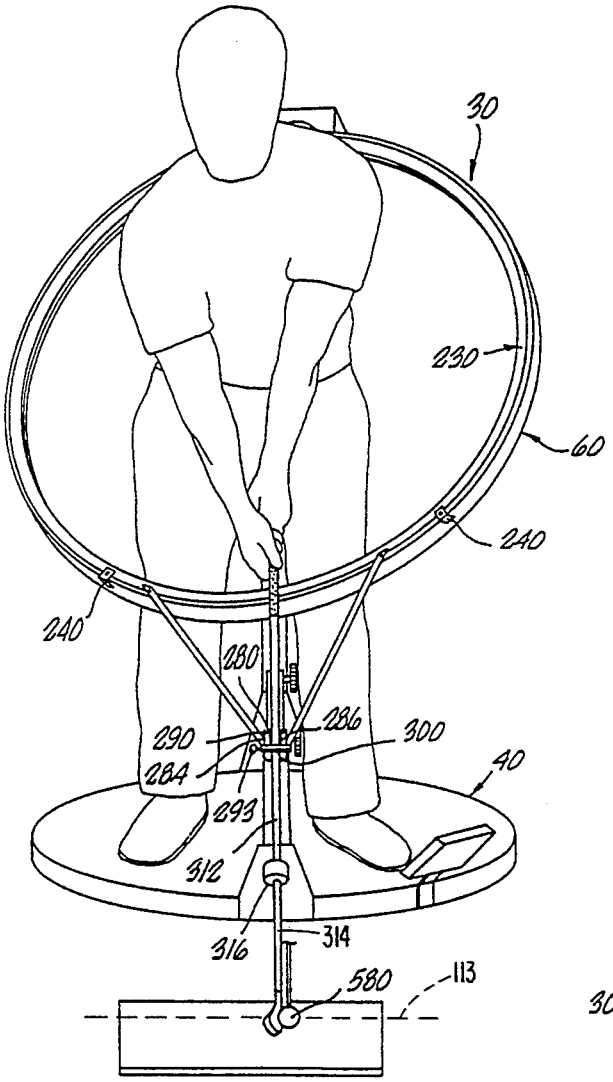
FIG. 17 shows a side elevational view of the FIG. 1 embodiment, superimposed with a perspective view of the ring sub-assembly rotated about an axis determined by the FIG. 7 lower axle and the FIG. 10 upper axle.

As best shown in FIG. 7, a bifurcated first (or lower) clamp 180 includes first and second sections 181 and 182, each having, respectively, a planar, generally circular, outer surface 183 and 184, and a cutaway, or recess shown as a concave inner surface 185 and 186. The surfaces 185 and 186 having a radius of curvature approximately equal to the convex radius of curvature of a first (or lower) axle 190 and, when assembled, provide a bore in which the axle 90 may be positioned. The surfaces 183 and 184 have, respectively, a centered hole 187 and 188 therethrough. The lower hollow axle 190 includes a lower portion 191, a middle portion 192 having a bore which terminates at first and second transversely elongated, diametrically opposite holes 193 and 194, and a truncated upper end 195. End 195 faces in a direction orthogonal to longitudinal axis of the middle portion 192. Middle portion 192 is disposed, after assembly, between and within the bore formed by clamp sections 181 and 182. The lower clamp sections 181 and 182 and the lower axle 190 are positioned between the projections 168 and 170 so that the holes 172, 187, 193, 194, 188 and 174 are aligned. The axle 190 is rigidly maintained within the clamp sections 181 and 182 by inserting a locking bolt 200 having a knob 202 and a shaft 204 with threads 205 through the holes 172, 187, 193, 194, 188 and 174, until the threads 205 are engaged within the threaded receptacle 176. Clockwise rotation of the knob 202 causes transverse compression of the resilient projections 168 and 170, thereby transversely compressing the lower clamp sections 181 and 182 around the lower axle 190. Counterclockwise rotation of the knob 202 from the tightened position enables the axle 190 to be rotated axially relative to the clamp sections 181 and 182, to an extent permitted by the width of the bore which terminates at holes 193 and 194, and also enables the lower clamp 180 to be pivoted or rotated about an axle formed by shaft 204 and relative to the projections 168 and 170. In this way, the azimuth of the ring sub-assembly and/or the rotation of the ring sub-assembly about an axis which is the longitudinal centerline* of axle 190. The azimuth angle, $\Psi$, is shown in FIG. 17.

In the preferred embodiment, the member 150 is fabricated from square cross-section metal tubing having inner dimensions of 2 inches$\times$2 inches, and is about 12 inches in length. The member 160 is fabricated from square cross-section metal tubing having outer dimensions of $1\frac{3}{4}$ inches$\times$$1\frac{3}{4}$ inches, and is about 12 inches in length. The lower axle 190 is preferably a one-inch diameter steel tube, and is about $4\frac{1}{8}$ inches in length.

The first stanchion sub-assembly may be of virtually any of many various designs, heights and/or dimensions, so long as it functions to enable the user to (a) adjust the vertical position of one point on the ring sub-assembly; (b) adjust, preferably in combination with the second stanchion sub-assembly, the angle of rotation, or azimuth angle, of the ring sub-assembly about an axis which is a line between the points of connection of the ring sub-assembly to the first and stanchion sub-assemblies, respectively; and (c) adjust, preferably in combination with the second stanchion sub-assembly, the angle of elevation of the ring sub-assembly.

D. Stationary And Rotatable Ring Sub-Assembly

Figure 9:
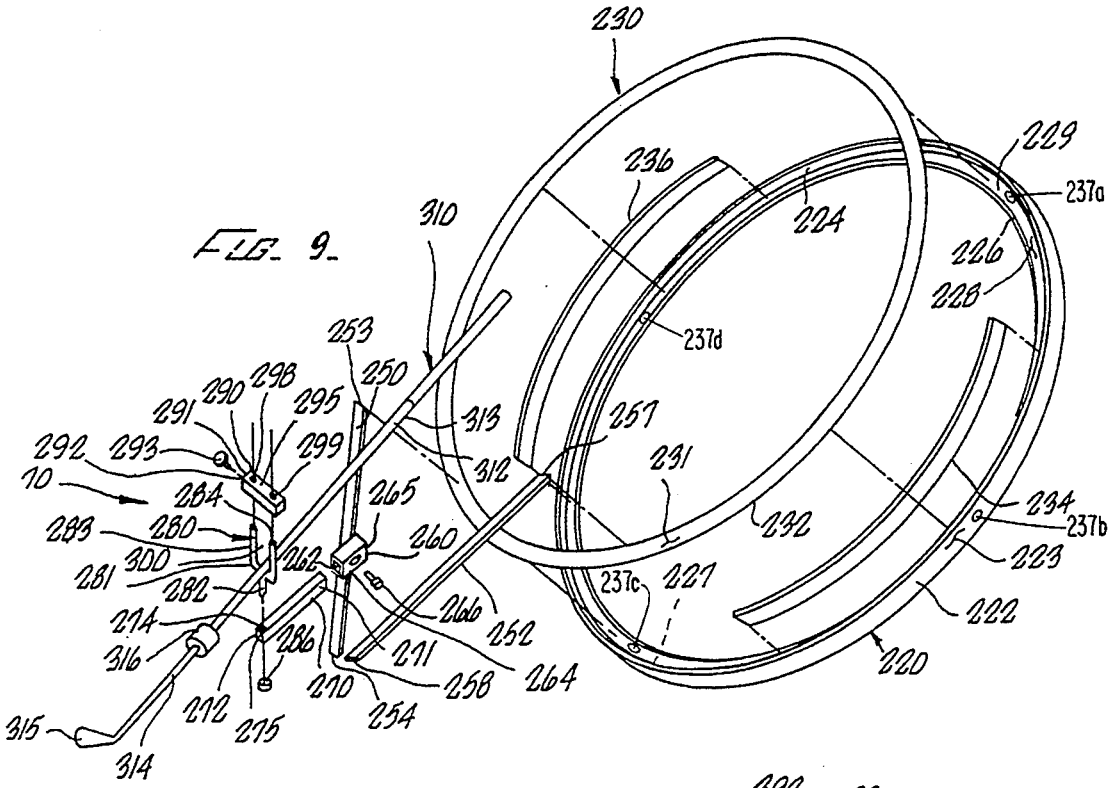
FIG. 9 is an exploded perspective view of the FIG. 6 angle member and a rotatable tubular member of the ring sub-assembly, a club-holder sub-assembly including first and second frame members, a housing, a shaft including a swivel connector, a U-shaped member, a slidable cross-piece and a shaft stop member, and a golf club.
Figure 10:
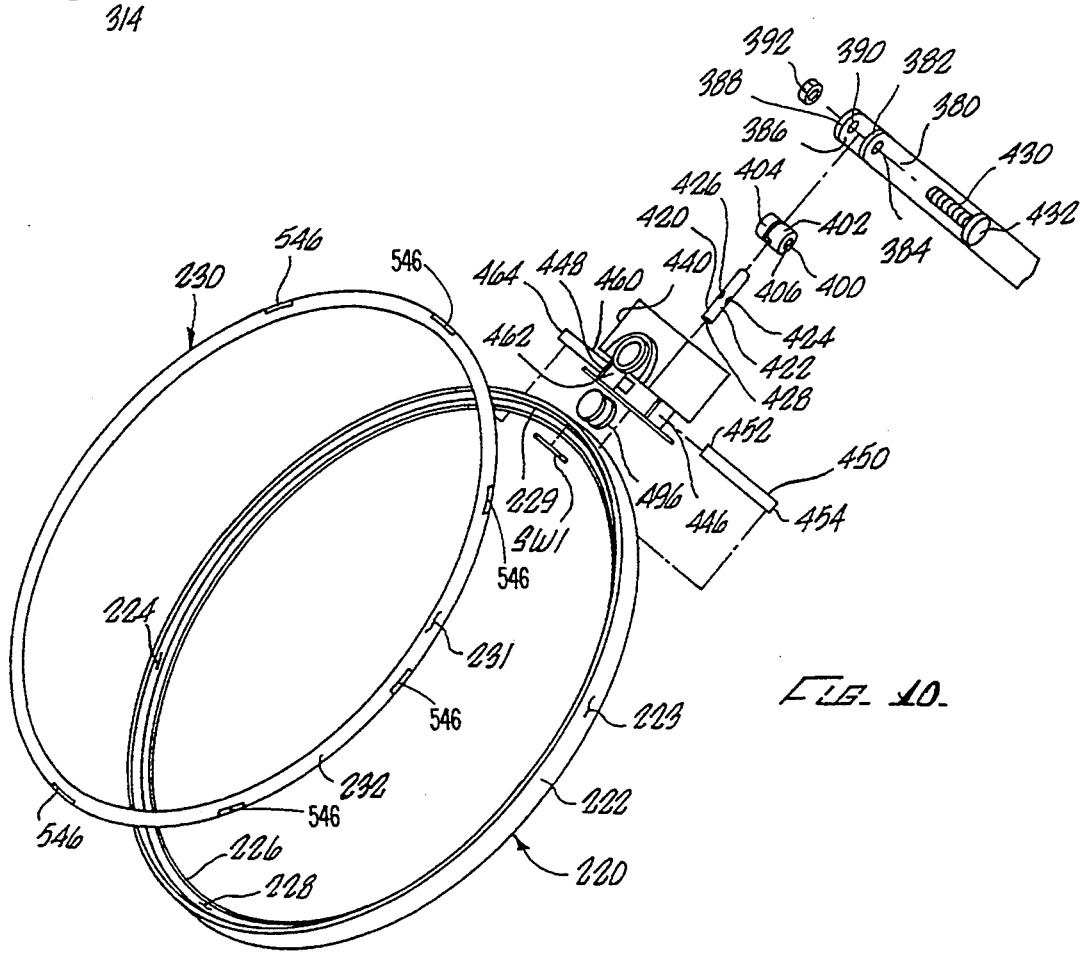
FIG. 10 is an exploded perspective view of the FIG. 6 angle member, the FIG. 9 rotatable member, the proximal portion of the FIG. 8 elongated member, an upper clamp, an upper axle, a box-shaped housing, first and second mounting brackets, a clutch, a governor wheel, and a magnetic switch.
Figure 18:
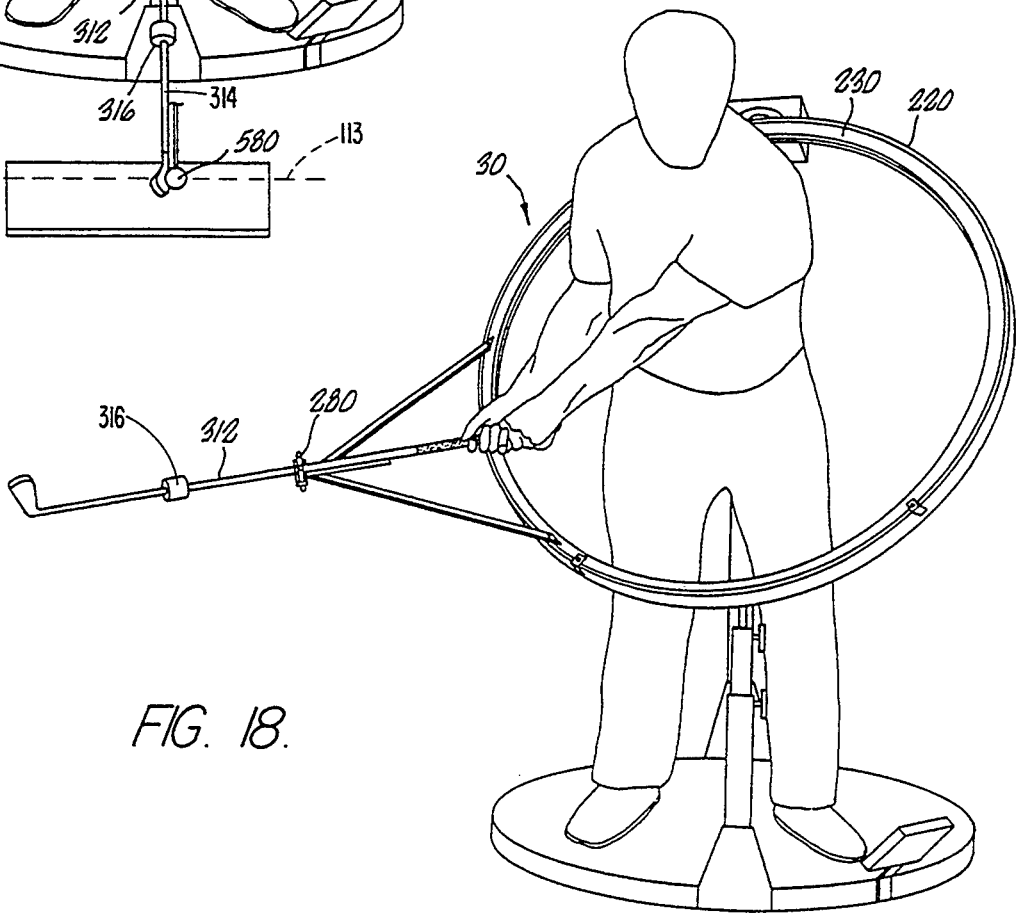
FIG. 18 is a perspective view of the FIG. 1 embodiment where a person in the set-up phase of a full-range of motion golf swing is constrained to swing a club within a predetermined swing plane.

Referring to FIGS. 6, 9 and 10, the stationary and rotatable ring sub-assembly 60 includes a generally circular angle member or stationary ring 220 having a first flange 222 with an exterior surface 223 and an interior surface 224, and a second flange 226, orthogonal to the flange 222, with an exterior surface 227 and an interior surface 228, the interior surfaces 224 and 228 forming an annular recess 229. A circular cross-section, tubular member or rotatable ring 230 having an exterior surface 231 and an outer edge surface 232 is closely received within the recess 229. In the absence of an external frictional force, the rotatable ring 230 is freely rotatable within the recess 229 of stationary ring 220. As shown in FIG. 9, rotation of the ring or member 230 is facilitated by first and second curved strips 234 and 236, fabricated from a material with a low coefficient of kinetic friction such as teflon, the strips 234 and 236 being rigidly attached to the interior surface 224 and interposed between the surfaces 224 and 232. Additionally, a plurality of teflon buttons 237A, B, C and D are rigidly attached to the top surface of flange 226 to provide a sliding surface on flange 226 for the ring 230. Preferably a minimum of eight buttons, spaced radially equidistant are used, four of which are shown in FIG. 9. Alternatively, other means of facilitating rotation of the ring or member 230, such as a plurality of roller bearings, may be disposed between the surfaces 224 and 232. As shown in FIG. 18, the rotatable ring 230 is movably retained within the recess 229 by a plurality of retainer clips 240.

Referring to FIG. 6 upper end 195 of the lower axle 190 is rigidly attached to the exterior surface 227 of the flange 226, thus constraining the stationary ring 220 within the device 30 for a given setting of the lower stanchion sub-assembly 50.

In the preferred embodiment, the stationary ring 220 is fabricated from metal or plastic, and has an outer diameter of about 43 inches. The width of the flange 222 is about $1\frac{1}{4}$ inches, and the width of the flange 226 is about 11/16 inches. The rotatable ring 230 is fabricated from $\frac{7}{8}$-inch circular metal tubing, and has an inner diameter of about 41 inches. The strips 234 and 236 are each about 48 inches in length.

The stationary and rotatable ring sub-assembly may be of virtually any design, structure and dimension so long as it functions (a) to enable one point on the structure to rotate within a plane and through a full range of swing motion; (b) to accommodate various vertical and angular orientations of the plane; and/or (c) to accommodate instrumentation for measuring the speed and/or force of the swing motion.

E. Club-Holder Sub-Assembly

Referring to FIG. 9, the club-holder sub-assembly 70 includes first and second lath-shaped frame members 250 and 252. Frame member 250 has a first (or proximal) end 253 and a second (or distal) end 254. Frame member 252 has a first (or proximal) end 257 and a second (or distal) end 258. The proximal ends 253 and 257 are symmetrically disposed and rigidly connected to the exterior surface 231 of the rotatable tubular member 230. The distal ends 254 and 258 are rigidly connected to a housing 260 having a longitudinal bore 262 therethrough. Housing 260 includes a longitudinal side 264 with a hole 265 wherein is disposed a first set-screw 266.

The housing 260 is the apex of a triangle whose legs are the frame members 250 and 252, and whose base is an imaginary chord between the proximal ends 253 and 257. The plane in which the frame members 250 and 252 are disposed is offset from the plane in which the ring sub-assembly 60 is disposed. In the preferred embodiment, the offset angle is about 20°, as illustrated by angle $\phi$ in FIG. 2.

A shaft 270 having a first (or proximal) end 271, a second (or distal) end 272, and a predetermined length is slidably disposed within the bore 262. The position of the shaft 270 within the housing 260 is fixed by tightening the set-screw 266. Disposed within the shaft 270 near the end 272 is a swivel connector 274 having a bore 275. A two-tined fork, or "U"-shaped member 280 including a base 281, a threaded base projection 282, and first and second legs or tines 283 and 284, is disposed orthogonal to the shaft 270, the projection 282 received within the bore 275 and maintained in a fixed position relative to the shaft 270 by a threaded nut 286. A cross-piece member 290 including a first end 291 with a longitudinal bore 292 in which is disposed a second set-screw 293, and further including first and second parallel surfaces 295 and 296 having first and second bores 298 and 299 therethrough, is transverse to and, through the holes 298 and 299, slidably disposed along the legs or tines 283 and 284 of the U-shaped member 280. The legs 283 and 284, the base 281, and the cross-piece member 290 thus determine a bounded planar opening 300.

When the device 30 is in use, a golf club 310 having a shaft 312 including an upper portion 313, a lower portion 314, and a club head 315 transects the opening 300. The area of the opening 300 is several times larger than the cross-sectional area of the shaft 312, enabling the shaft to freely move longitudinally and axially. A stop member 316 is positioned on the lower shaft portion 314 between the club head 315 and the opening 300. The stop member 316 is dimensioned to be larger than the opening 300, so that longitudinal upward motion of the club 310 within the opening 300 is limited by the stop member 316. The position along the shaft 312 of the stop member 316 is set according to the club position at the posting phase. The stop 316 is positioned to touch the device at opening 300, and function so that during downswing a pulling motion is required by the user. As shown in FIG. 9, stop member 316 is a right circular cylinder having a central bore sized to accommodate lower portion 314 of the club 310. Stop member 316 may be formed in numerous shapes and with numerous materials, so long as it performs the functions described above. Stop member 316 may be formed of an elastomeric, foam material so that it may be slipped over the club head or handle and positioned on the shaft, or may be of rigid material, so long as it may be positioned along the shaft and function as described.

In the preferred embodiment, the frame members 250 and 252 are each about 20 inches in length, the housing 260 is about $1\frac{5}{8}$ inches in length, the shaft 270 is about 7 inches in length and has cross-sectional dimensions of $\frac{1}{2}$-inch$\times$5/16-inch, the U-shaped member 280 is about $3\frac{1}{2}$ inches in length and $1\frac{3}{8}$ inches in width, and the cross-piece member 290 is about $1\frac{5}{8}$ inches in length.

The clubholder sub-assembly may be of virtually any design so long as it functions to provide a rest point for the club shaft to contact during each of the phases of the swing, with the rest point traveling in or parallel to the swing plane as the swing is executed and for initiation of a pulling motion on the downswing.

F. Upper Stanchion Sub-Assembly

Referring to FIGS. 5, 8, 10 and 11, the upper stanchion sub-assembly S0 includes a tubular member 330 having a lower portion 332, an upper portion 334, and first and second parallel sides 336 and 338. The portion 332 is rigidly attached to the second stanchion bracket 144. The sides 336 and 338 extend upwardly, respectively, in a first projection 340 having an upper end 342 and including a bore 344, and a second projection 346 having an upper end 348 and including a bore 350 and a receptacle or nut 352 adapted to receive a first threaded, locking bolt 378.

As shown in FIG. 8, an elongated member or arm 360 includes parallel first and second sides 362 and 364 having, respectively, parallel first and second longitudinal slots 366 and 368. The member 360 further includes a distal end 370, a middle portion 372, and a proximal portion 374. The middle portion 372 is transversely disposed between the projections 340 and 346 so that the slots 366 and 368 are aligned with the bores 344 and 350. First locking bolt 378, having a knob 379, passing successively through bore 344, slot 366, slot 368, and bore 350 is secured by nut 352. Counterclockwise rotation of the knob 379 enables translational movement and/or pivoting movement of the member 360 with respect to the locking bolt 378. Clockwise rotation of the knob 372 enables fixing the position of the member 360 relative to the upper stanchion member 330. In this manner, the arm 360 may be rigidly maintained in a desired position and its position may be adjusted, in cooperation with the lower stanchion sub-assembly, to accommodate different vertical positions, elevation angles and azimuth angles of the ring sub-assembly.

As also shown in FIG. 8, the side 362 extends proximally in a first projection 380 having an end 382 and including a bore 384, and the side 364 extends in a second projection 386 having an end 388 and including a bore 390 and a threaded receptacle or nut 392 adapted to receive a second threaded bolt 430.

As shown in FIGS. 10 and 11, a bifurcated second (or upper) clamp barrel 400, including first and second sections 402 and 404 having, respectively, bores 406 and 408, is disposed between the projections 380 and 386. The configuration and dimensions of the sections 402 and 404 are identical to those of the lower clamp sections 181 and 182. A second (or upper) axle 420 including a middle portion 422 having a transverse bore terminated at first and second enlarged, diametrically opposite holes 424 and 426, and a lower end 428 is disposed in the bore formed between and by the cutaway portions of the clamp sections 402 and 404. The upper clamp sections 402 and 404 and the upper axle 420 are positioned between the projections 380 and 386 so that the bores and holes 384, 406, 424, 426, 408 and 390 are aligned. The axle 420 is rigidly maintained within the clamp sections 402 and 404 by a second threaded locking bolt 430 having a knob 432, the bolt 430 passing successively through the bores and holes 384, 406, 424, 426, 408 and 390 until engaged within the nut or receptacle 392. Clockwise rotation of the knob 432 causes transverse compression of the resilient projections 380 and 386, thereby transversely compressing the upper clamp sections 402 and 404 around the upper axle 420. Counterclockwise rotation of the knob 432 from its tightened position loosens the sub-assembly and enables the axle 420 to be rotated about its longitudinal axis as well axially relative to the clamp sections 402 and 404, to an extent permitted by the diameter of the oversize bore and holes 424 and 426, and also enables the upper clamp 400 to be rotated about an axis which is in the centerline of bolt 430 when inserted through bores 384 and 390 of projections 380 and 386. In this way, the azimuth of the ring sub-assembly may be fine-tuned, and, in cooperation with the first stanchion sub-assembly the degree of rotation of the ring sub-assembly about an axis which passes through the longitudinal centerline of upper axle 420 may be adjusted.

Referring again to FIGS. 10 and 11, a rectangular box-shaped housing 440 includes a top side 442, and first and second extension members 446 and 448 generally vertical to the side 442. A first mounting bracket 450 is rigidly attached at a first end 452 to the member 446, and at a second end 454 to the surface 227 of the flange 226 of the angle member 220. A second mounting bracket 460 is rigidly attached at a first end 462 to the member 448, and at a second end 464 to the surface 227. The lower end 428 of the upper axle 420 is rigidly attached to the side 442, the centerlines of axles 190 and 420 disposed along a plane intersecting a diameter of the angle member 220.

In the preferred embodiment, the stanchion member 330 is about 55" in length, and has cross-sectional dimensions of $2\frac{1}{4}'' \times 2\frac{1}{4}''$ . The arm member 360 is about 29" in length, and has cross-sectional dimensions of $1\frac{3}{4}'' \times 1\frac{3}{4}''$. The slots 366 and 388 are each about 20" in length and 7/16" in width. The upper axle 420 is 1" in diameter and about 4" in length. The housing 440 has dimensions approximately 8" in length×4" in width×6" in height.

The second stanchion sub-assembly may be of virtually any design so long as it provides, preferably, a point of contact and support for the ring sub-assembly which is on the opposite end of the diameter extending to the point of contact with the first stanchion sub-assembly. The second stanchion sub-assembly also, preferably, provides structure which, in cooperation with the first stanchion sub-assembly, permits the azimuth of the ring sub-assembly to be adjusted by rotating the ring sub-assembly about a diameter between the two connection points. The second stanchion sub-assembly also functions, preferably, to provide a support for the clutch or resistance sub-assembly to contact the rotatable portion of the ring sub-assembly. The second stanchion sub-assembly also functions, preferably in conjunction with the first stanchion sub-assembly, to permit adjustment of the angle elevations of the ring sub-assembly.

G. Hydraulic Resistance Sub-Assembly

Figure 12:
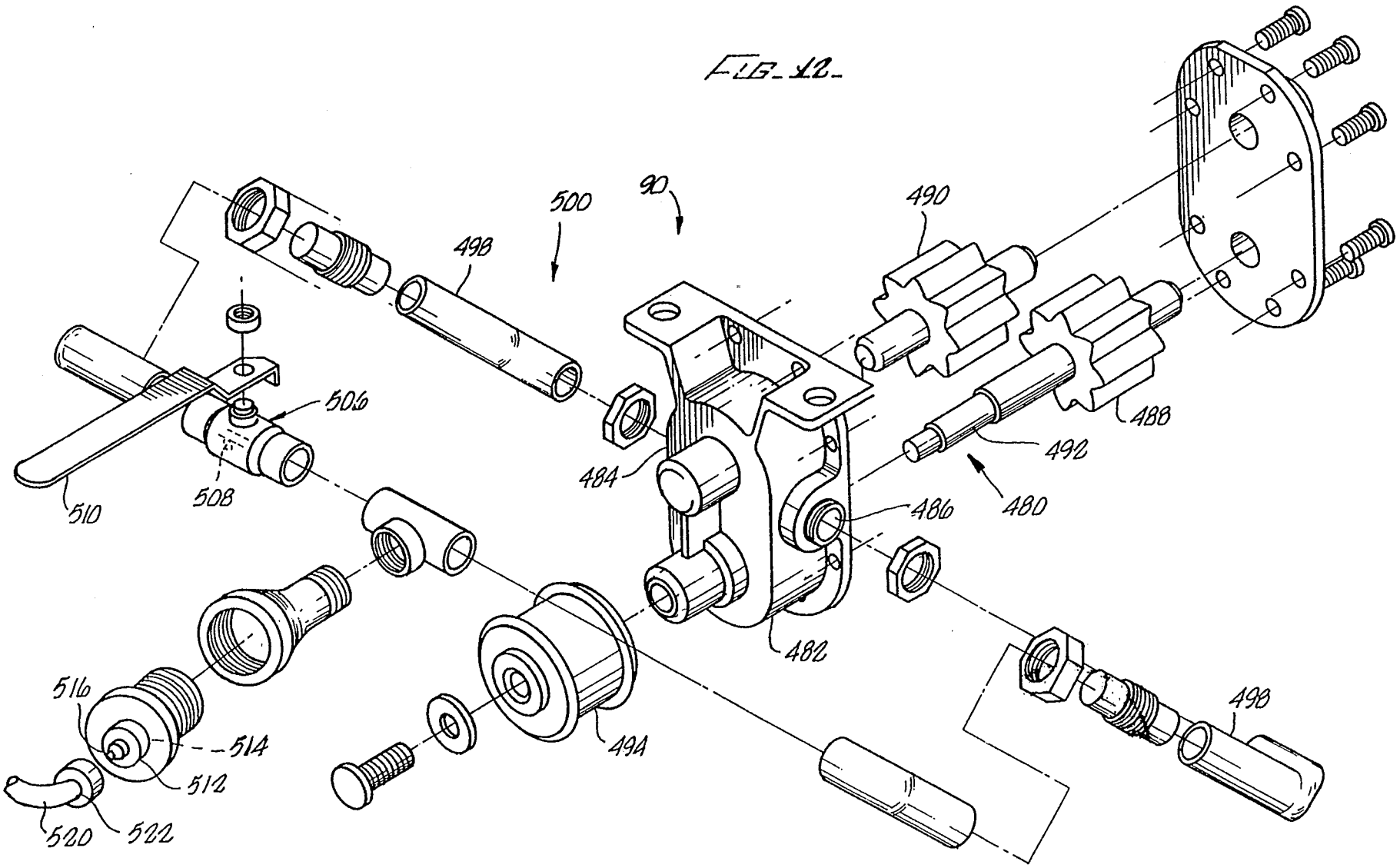
FIG. 12 is an exploded perspective view of a hydraulic gear pump, a drive shaft, the FIG. 10 clutch, a flow restricting valve, a needle valve, a rigid hydraulic fluid conduit, and a flexible hydraulic fluid conduit.

Shown in FIG. 12 is an exploded perspective view of the hydraulic resistance, or clutch, sub-assembly 90, some of the components of which will be discussed below as they relate to the present invention. The sub-assembly 90 includes: a hydraulic gear rotary pump 480 mounted within the housing 440 (not shown in FIG. 12). Pump 480 has a pump housing 482, an outlet port 484, an inlet port 486, a drive-gear 488, and an idler-gear 490. A drive-shaft 492 is rigidly connected to the drive-gear 488 and extends in a generally perpendicular direction from the pump housing 482. A one-way clutch 494 is rotatably connected to the drive-shaft 492 with conventional one-way needle bearings (not shown). A friction-type governor wheel 496, best shown in FIG. 10, is mounted on the housing 440. Alternately, a sprocketed, one-way clutch could be used, in which case no governor would be needed, and ring 230 would have meshing gear teeth. Conduit 498 fluidly connects the discharge, or outlet port 484 and the inlet port 486, so as to constitute a closed fluid circuit, or flow system 500. A conventional flow restricting valve 506, having a conventional, adjustable aperture 508 is positioned in the circuit downstream of discharge 484 and upstream of connector 512. The degree of opening of aperture 508 is adjusted by a lever arm 510. Connector 512 has an inlet 514 and an outlet 516. Flexible conduit 520 is filled with hydraulic fluid during operation and has a first end 522 and a second end 524. End 522 is connected to the outlet 516 of the needle valve 512, and end 524 is connected to a pressure sensor 546, including a piezoresistive transducer 548.

In the preferred embodiment, the gear pump 480 is model number AJN, manufactured by Sterling Pump, Ltd. of Mississauga, Canada. The drive-shaft 492 extends about $1\frac{3}{8}''$ outside of the pump housing 482. The clutch 494 is about $3\frac{1}{4}''$ in diameter. The flow restricting valve 506 is a conventional ball valve. The pressure transducer 548 is a piezoresistive strain gauge, part number MPX200DP, manufactured by Motorola Corporation.

Numerous pump designs may be adapted for use with the present invention so long as the pump will provide an isokinetic resistance. Preferably, a positive displacement pump is used because such pumps operate to approximate total isokinetic resistance. Similarly, any conventional piezoresistive strain gauge may be adapated into the design when used with a conentional wheatstone bridge.

The rotatable tubular member, or ring, 230 is pinched between the clutch 494 and the governor wheel 496. As the user applies force to the golf club during the downswing, the resultant rotating of the ring 230, which is in frictional contact with the clutch 494, causes the clutch and thus the drive-shaft 492 to rotate. Rotation of the drive-shaft 492 causes the drive-gear 488 of the gear pump 480 to rotate at the same angular speed as the drive-shaft. Rotation of the drive-gear 488 causes the idler-gear 490, which is meshed with the drive-gear 488, to also rotate, resulting in pumping of hydraulic fluid between the gears 488 and 490, from the inlet side 486 of the chamber inside of the pump 480 to the discharge side 484.

The rate of flow of hydraulic fluid which can circulate in the closed system 500 is limited by the aperture 508 of the flow restricting valve 506 to control maximum speed of the ring. Predetermined set points can then be established on the valve so that different maximum speeds, to accommodate the needs of different swings can be established. Thus, resistance to the rotation of the ring through swinging of the club can be adjusted by controlling the opening of valve 506. In this way, true isokinetic exercise during the swing may be achieved, with the initial or base resistance determined by the degree of opening of the aperture 508. The initial valve setting is selected according to the training velocity desired by the user. Thus, the swing training device of the present invention may be used to improve the power of a swing, and thereby the distance the ball travels. The force component of power training is dominant when using valve settings which are relatively closed. The velocity component of power may be trained by using valve settings which are relatively open.

Because the maximum speed is set by setting the valve aperture 508, the pressure in the hydraulic system will be proportional to the force applied during the swing. transducer PT1 generates an electrical signal proportional to pressure. Thus, information concerning the force applied by the user can be measured, displayed and used for further training. Thus, measurement of the pressure instantaneously imposed on Transducer PT1 at selected positions along the downswing arc, or electrical signals corresponding to those pressures, provides information at various phases of the swing. This feedback information may then be used to improve the swing by comparing the profile of the measured values with an optimum profile.

The hydraulic resistance sub-assembly may incorporate various designs, so long as it functions to provide substantially isokinetic resistance to the swing initiated by the user and/or provides for sensing instantaneous hydraulic pressure in the system as a swing is executed.

H. Electronic Monitoring Sub-Assembly

Figure 13:
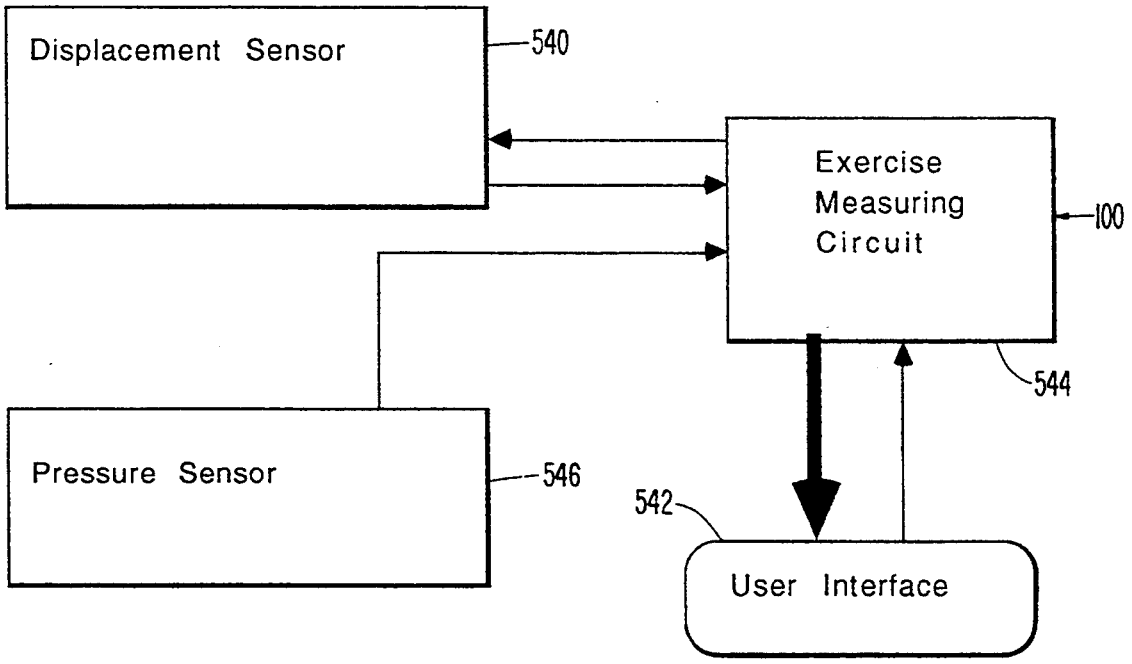
FIG. 13 is a block diagram of an electronic monitoring sub-assembly of the FIG. 1 embodiment.

The electronic monitoring sub-assembly 100 shown in the block diagram of FIG. 13 functionally includes a displacement sensor 540, a user interface 542 and a monitoring controller 544 electrically connected in circuit with the displacement sensor 540, user interface 542 and pressure sensor 546. The monitoring controller 544 is responsive to user signals from the user interface 542 to monitor exercise progress using sensor signals provided by the displacement sensor 540 and the pressure sensor 546 of exercise characteristics during operation. Exercise progress is reported to the user by output signals sent from the monitoring controller to the user interface. These functional devices all comprise electronic circuitry not shown in FIG. 13, but shown in FIGS. 14 and 25–29.

Figure 14:
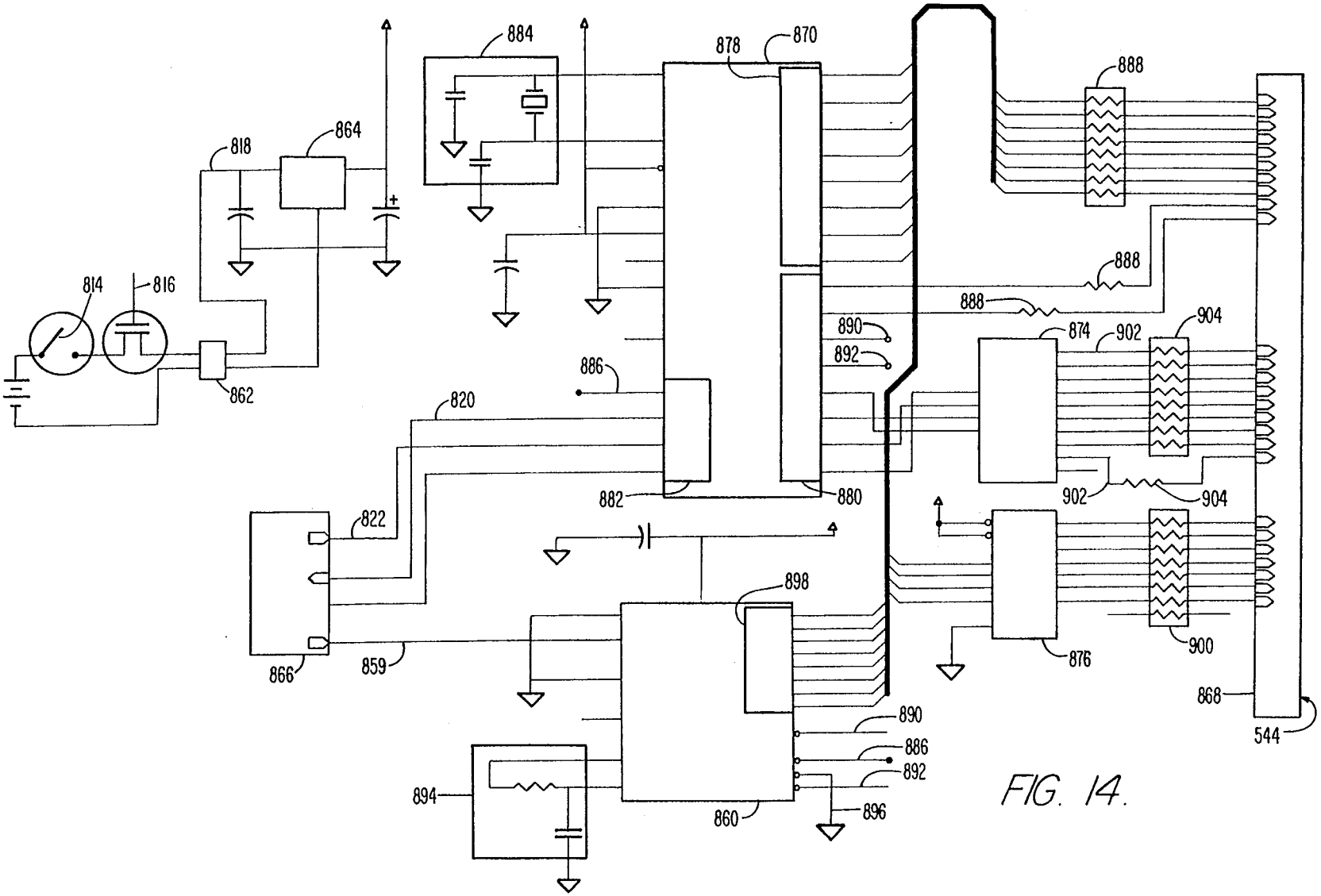
FIG. 14 is a circuit diagram of the FIG. 13 monitoring controller.

With reference to FIG. 14, the user interface 542 comprises a display panel 550 consisting of a series of six vertically aligned light emitting diode (LED) bar graph sets 552, distributed horizontally across the display panel cover. Each LED set 552 consists of a vertical stack of ten LEDs for displaying an analog readout of exercise information. The bar graphs positioned in this manner cooperate to complete a bar graph display of golf swing information. Positioned above the LED bar graph sets, a numeric display 554 provides a three place numerical readout of exercise information. The numeric display 554 can be used to numerically show the force applied at the zero point or ball impact point of the golf swing, to summarize the golf swing bar graph results or to display supplemental information relevant to exercise progress.

In accordance with the preferred embodiment of the invention, the LED set 552 may be a ten-position bar graph, Type SSA-LXH1025SRD, manufactured by Lumex and sold by Digikey Corp of Thief River Falls, Minn. under model no. LU2002B1-ND and the numeric display 554 may be a combination of a seven-segment common cathode LED, Type LN526K, and a dual seven segment common cathode LED, Type LN526K, manufactured by Panasonic Corp. of Japan. It is believed that this combination of LED display elements provides the user with a simple economic graphical and numerical listing of exercise progress during each golf swing. In accordance with the broad aspects of the invention, the user interface may include any type of visual display or audible signal that provides exercise feedback to the user including a liquid crystal display (LCD) panel, a more detailed LED graphical arrangement or even audible signals showing whether the user is doing golf swings at a desired level of performance.

A 26 lead data and address bus 556 connects the display panel with the monitoring controller. Nine leads 558 provide addressing of the data to the respective LEDs. The numeric display 554 connects electrically to the monitoring controller in a conventional manner. With reference to the independent numeric LED, each seven-segment LED element connects in a parallel conventional manner to a seven bit data bus with a common cathode connecting to the collector of a transistor 800. The transistor 800 connects to a respective address lead 802 at the base and to ground 804 at the emitter. The transistor 800 functions as an address latch for receiving signals through the respective data leads when an enable signal is received at the transistor base through the respective address lead 802. In a similar manner, each of the LED bar graphs is connected in parallel to a 10-bit data bus 806. The individual LEDs on the respective bar graphs are connected to a common cathode lead which connects to respective the collector of respective transistors 808. With reference to a first bar graph 552, each transistor is configured in a manner similar to the configuration for the numeric displays such that an enable signal transmitted to the transistor base 810 causes signals from the 10-bit data bus to pass through the respective bar graph LED to ground 812. In each case, when the address latch has been enabled, a data bit having a high or "1" signal illuminates the respective LED and a low or "0" signal does not illuminate the respective LED.

The user interface 542 also includes foot switches 814 and 816 for allowing the user to control the operation of the electronic sub-assembly. Located proximate the display panel, the preferred embodiment includes a power switch 814 and a swing reset button 816. The power switch 814 can consist of any conventional type toggle switch or push button toggle. The swing reset button 816 may be any conventional type of spring biased switch that remains in a short circuit position, when biased by the spring. In the present embodiment both switches are serially connected between a power supply, consisting of a 9-volt battery pack, and the power supply lead 818 to the monitoring controller.

In accordance with the broad aspects of the invention, the swing reset button 816 may connect (not shown) between the power load and an input lead of the monitoring controller for enabling a variety of mode selections other than simply resetting the monitoring controller after each golf swing. In addition, the user interface may include more specialized button controls such as a separate mode selection switch for deciding the type of data to measured or a memory recall switch for retrieving saved exercise information from previous workouts.

The displacement sensor 540 is preferably a photoelectric sensor 818 capable of sensing the contrast between light and dark surfaces. White marks (not shown), approximately 1 cm in width, are positioned equidistantly overlying a black matte finish about the circumference of the rotatable ring. The photoelectric sensor 818 disposed on the stationary ring shaped angle member is operative to sense the changes between the white and black regions on the rotating ring surface by measuring the illumination from an LED reflected off the surface and intercepted by a light sensitive transducer both included in the sensor. In the preferred embodiment of the invention, the light sensor may be a Type EE-SB5V manufactured by Omron Corp. A signal representative of a white mark is sent to the monitoring controller upon the white mark passing within 5 mm of the light sensor.

The displacement sensor further includes a sensor enable lead 820 and a sensor signal lead 822 that connect to the monitoring controller. A 5 v power load 824 connects to the photoelectric sensor power lead 826 and across a 4.7K ohm resistor 828 to the sensor signal lead 822. The LED cathode connects to common ground lead 830 through a 470-ohm resistor 832 that adjusts the photo sensor sensitivity. The common ground lead 830 connects to the collector of a transistor 832. The transistor base includes a 4.7K ohm current limiting resistor 834 at the base that connects to the sensor enable lead 820. The transistor emitter connects to ground 836. The displacement sensor, upon receiving an enable signal from the sensor enable lead 820, actuates the photo sensor to determine whether the white mark is in view of the photo sensor. If a white mark is detected, a signal is sent to the monitoring controller indicating detection. Since the sensor is not continuously active, the width of the white mark should correspond to the period between sensor cycles as determined by estimated swing velocity.

The pressure sensor 546 includes an electronic interface for connecting to the monitoring controller that includes a power lead 838 from the monitoring controller that passes through a forward biased LED 840. The LED functions as a "power on" indicator and diagnostic indicator that ensures the pressure transducer 548 is receiving power. The pressure transducer 548 includes a load lead 842 connected to the cathode of the LED, a negative lead 844 connected to ground, and positive and negative output leads 846 and 848 connected to respective input terminals on a differential amplifier 850. The resistance loads across the leads are configured with resistance values to measure the difference in the voltage loads. The output lead 852 of the differential amplifier connects to a high gain amplifier 854 configured to increase the magnitude of the pressure transducer signal. The output lead 856 of the high gain amplifier connects to a voltage follower 858 which functions as a buffer to the monitoring controller.

In the preferred embodiment, the pressure sensor output is measured by an 8-bit analog to digital (A/D) convertor 860 that is able to measure a 5-volt range in 256 discrete increments (FIG. 14). By estimating each increment is equal to 0.3 PSI, it is estimated that a useful pressure range of 48 PSI is sufficient to measure the force exerted during exercise. Those skilled in the art will appreciate that the estimate must account for tolerances in the operational amplifier and the pressure transducer. Accounting for tolerances, the operational amplifier is set for a 32.6 gain that provides a useful voltage range between 0 and 3.1 volts or 0 and 160 increments measured by the monitoring controller.

The monitoring controller 544 includes three main connection ports. A first port 862 connects to the power supply through the user interface and provides power to the electronic sub-assembly. The power leads connect through the user interface switches to the input lead of a balanced 5-volt voltage regulator 864. In the preferred embodiment the voltage regulator can be Type LM78L05ACZ manufactured by National Semiconductor. A second port 866 connects to the displacement and pressure sensor leads. Finally, the third port 868 connects the 26 lead bus 556 to the display portion of the user interface. The monitoring controller includes generally a microprocessor 870 connecting to the A/D convertor 872 for digitizing input signals from the pressure sensor. An addressing decoder 874 and numeric display data decoder 876 connect between the microprocessor and the display panel.

In the preferred embodiment, the microprocessor 870 can be a Type PIC 16C55, manufactured by Micrchip and sold by Digikey Corp of Thief River Falls, Minn. under model no. PIC16C55-HS/P-ND. This microprocessor features 8-bit addressing with two 8-bit data ports 878 and 880 and a 4-bit data port 882. Timing is provided by an 8 MHz clock 884 conventionally connected to the microprocessor. The 4-bit port 882 connects to the sensor enable and sensor signal leads 820 and 822 of the displacement sensor and a control status lead 886 on the A/D convertor 860. The first 8-bit port 878 connects to an 8-bit data bus which interconnects the microprocessor to the A/D convertor, the numeric display decoder and comprises eight of the leads of the 26-bit display panel bus thereby connecting 8 of the 10 leads of the LED bar graph displays through current limiting resistors 888. The second 8-bit port 880 is actually divisible into two 4-bit ports. The first 4-bits connects to the address decoder 874 and comprise the address bus for the display panel. The second 4-bits provides two additional data leads to the display bus connecting 2 of the 10 leads in the LED bar graph displays through current limiting resistors 888. The other two leads connect to the interrupt and write leads 890 and 892 of the A/D convertor.

The A/D convertor 872 connects to the pressure sensor output lead. A Resistor/Capacitor (RC) timing circuit 894 connects to the A/D convertor and functions as a clock for the convertor. The RC circuit is configured for a 6.25 KHz cycle in the preferred embodiment. The A/D convertor 872 connects to the output lead of the voltage regulator 864 for power. A read lead 896 is connected to ground thus configuring the A/D convertor for write only operations. An 8-bit port 898 connects to the 8 bit microprocessor data bus. In the preferred embodiment, the A/D convertor 872 can be Type ADC0804 manufactured by National Semiconductor Corp.

The numeric display decoder 876 provides a binary coded decimal (BCD) to 7-bit conversion. These four input bits comprise the first 4-bits of the 8-bit data bus port 878. The 7 output leads are impeded by current limiting resistors 900 and connect through the display bus to the seven segment input leads of the numeric displays. In the preferred embodiment, the numeric display decoder can be Type CD4511BCN manufactured by National Semiconductor Corp.

The address decoder 874 provides a binary to decimal conversion for addressing the six LED bar graphs and the three numeric LED displays. The ten output leads 902 are impeded by current limiting resistors 904 and connect to the respective transistor base for each item addressed. In the preferred embodiment, the BCD to decimal convertor can be Type CD4028B manufactured by National Semiconductor Corp.

The monitoring controller 544 is configured to receive the sensor signals from the displacement and pressure sensors 540 and 546. The signals are digitally processed by the microprocessor for transmission of exercise information to the user through the user interface. In accordance with the broader aspects of the invention, it will be appreciated by those skilled in the art that aspects of the electronic sub-assembly may be accomplished by an analog device or a digital device comprising various signal processing means for tracking the exercise progress of the user. Furthermore, the monitoring controller and/or a display can be mounted remotely from the swing training mechanical components. The monitoring controller and/or the display when located remotely can be used in a gym or health club by a trainer to track the exercise progress of a classroom of golf swing users.

III. OPERATION OF THE ROTATING RING SWING TRAINING AND EXERCISE DEVICE

A. Device Adjustments To Accommodate Users Of Different Height, Different Stance, And Different Shot-Making Styles Referring to FIG. 15, when a user of the device 30 swings the club 310, thus causing rotation of the rotatable ring 230, the distal end 272 of the shaft 270 is constrained to move in a plane 560 which is parallel to a plane 565 which is the plane of the ring sub-assembly 60, and thus is parallel to the swing plane 570. Therefore, a point at the bottom of the U-shaped member 280, which is attached to the shaft 270 at 272, is constrained to move in the plane 560 because the club-holder sub-assembly 70 is rigidly offset from the plane 565 of tubular member 230. A point on the club head 315 extending from the shaft 312 ideally moves in a non-circular arc in the swing plane 570 to describe the swing path. Swing plane 570 is parallel to the planes 565 and 560 because the shaft is constrained within the opening 500 and against the U-shaped member by the golfer during the swing. The moving club head thus satisfies an essential requisite of an ideal golf swing in that the swing path is in the swing plane. It is an important feature of the present invention that its structure facilitates generation of a proper swing path in the swing plane and through a full range of motion.

When a right-handed golfer executes a full-range of motion swing, the club moves clockwise during the backswing portion of the swing with the 12 o'clock position being a point on the stationary ring adjacent the clutch 494, and counterclockwise during the downswing portion of the swing. For a left-handed golfer, the rotational directions are reversed. Consequently, a user, accordingly as he or she is a right-handed or left-handed golfer, must first select a device 30 with the resistance sub-assembly 90 configured so the clutch 494 frictionally engages the ring 230 during the downswing portion of the swing.

A user's height, arm length, and posture at address generally determine the height of his or her hands while gripping a club during the set-up phase so that the clubface squarely contacts the addressed ball. Posture is generally determined by the user's height, preferred swing plane, and length of the selected club. Consequently, initial adjustments are directed to the height and angle of inclination of the ring sub-assembly 60. Referring again to FIGS. 5 and 6, the height and angle of inclination of the ring sub-assembly 60 with respect to the base sub-assembly 40 are coarsely adjusted to generally match the user's height and preferred swing plane by sliding the first, or lower, stanchion member 160 within the lower stanchion member 150 so as to align one of the plurality of holes 164 with the hole 154 in the member 150. Concurrently, the elongated member 360 is moved linearly and/or pivoted with respect to the upper stanchion member 330 by loosening the locking pin 378 and moving the member 360 with respect to the pin 378 by means of the slots 366 and 368. Graduated markings may be provided on the lower stanchion member 160 and/or the elongated member 360 to facilitate identification of preferred settings. The initial, or gross adjusted position is rigidly maintained by inserting the pin 165 through the aligned holes 154 and 164. These initial adjustments are generally made only when a person first uses the device, or before the device is to be used by another person.

Referring again to FIGS. 2 and 15, after the initial adjustments are made, the angle of elevation $\propto$ of the ring sub-assembly 60 may be further adjusted by loosening the locking bolts 200 (FIG. 7) and 430 (FIG. S) which, when tightened, rigidly maintain, respectively, the axles 190 and 420 in the clamps 180 and 400. The user can then pivot the clamps 180 and 400 within the projections 168, 170 and 380, 382, respectively, so as to slightly change the angle of inclination. Graduated markings may be provided on the axles and clamps to facilitate identification of preferred individual settings. Such fine adjustment generally would be necessary if a person wished to train with golf clubs of significantly different length, e.g., a driver, a long iron, and a short iron.

When the locking bolts 200 and 430 are loosened, the ring sub-assembly 60 can be rotated about a diameter defined by the axles 190 and 420, because the axles can rotate within the clamps 180 and 400. Thus, the azimuth of the ring sub-assembly 60 can be changed relative to a target line extending from the golf ball to an imaginary target area or specific target such as a hole on a golf course. This fine adjustment is necessary when a person wishes to perfect a swing motion which slightly changes the swing path, thus resulting in fading or drawing a ball, rather than propelling the ball directly along the target line.

Figure 15:
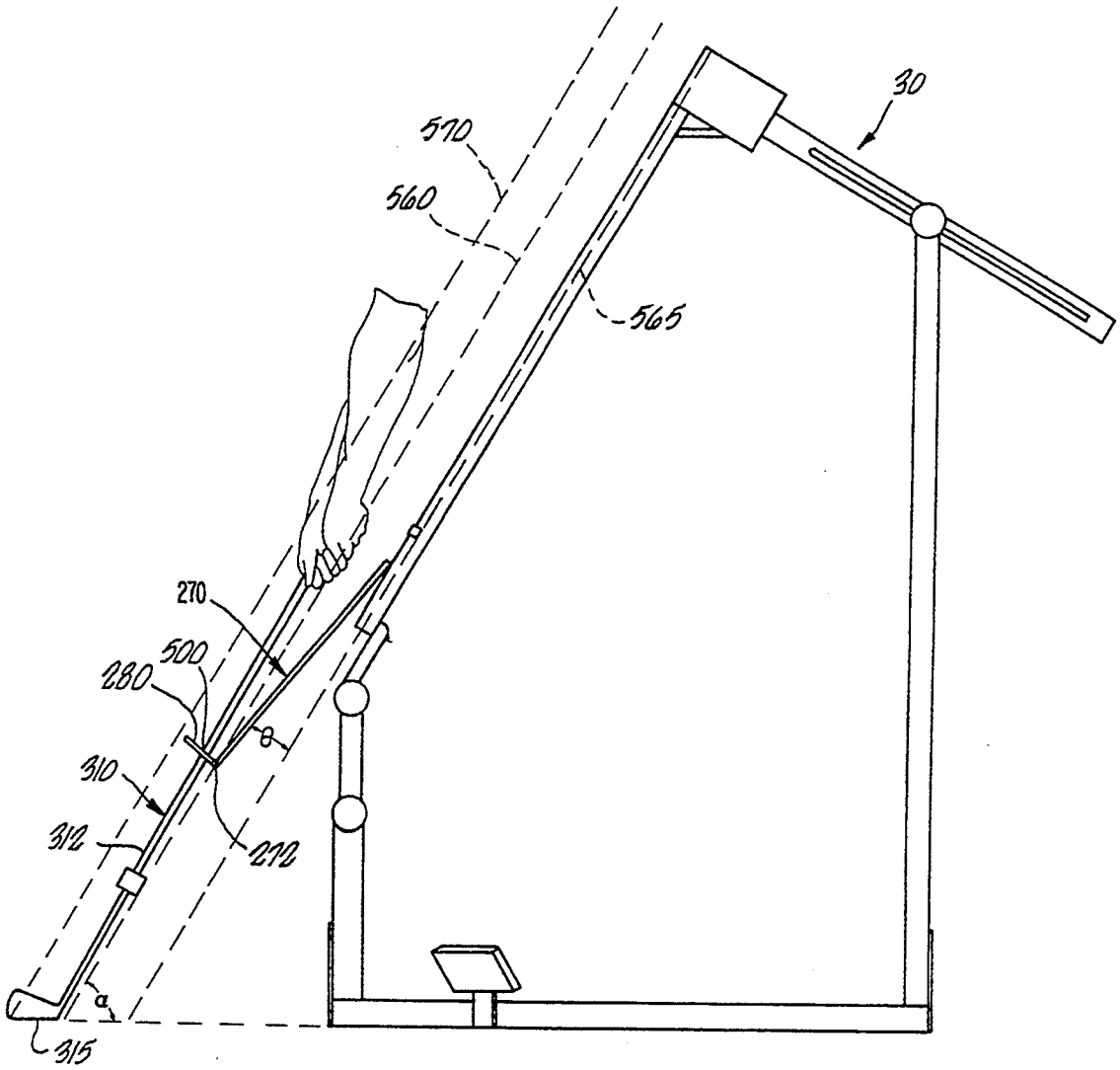
FIG. 15 shows the ring sub-assembly plane, a plane in which the distal end of the FIG. 9 shaft is constrained to move when the FIG. 9 tubular member rotates, and a plane in which the swing path of the FIG. 9 club head lies, the three planes being mutually parallel.
Figure 16:
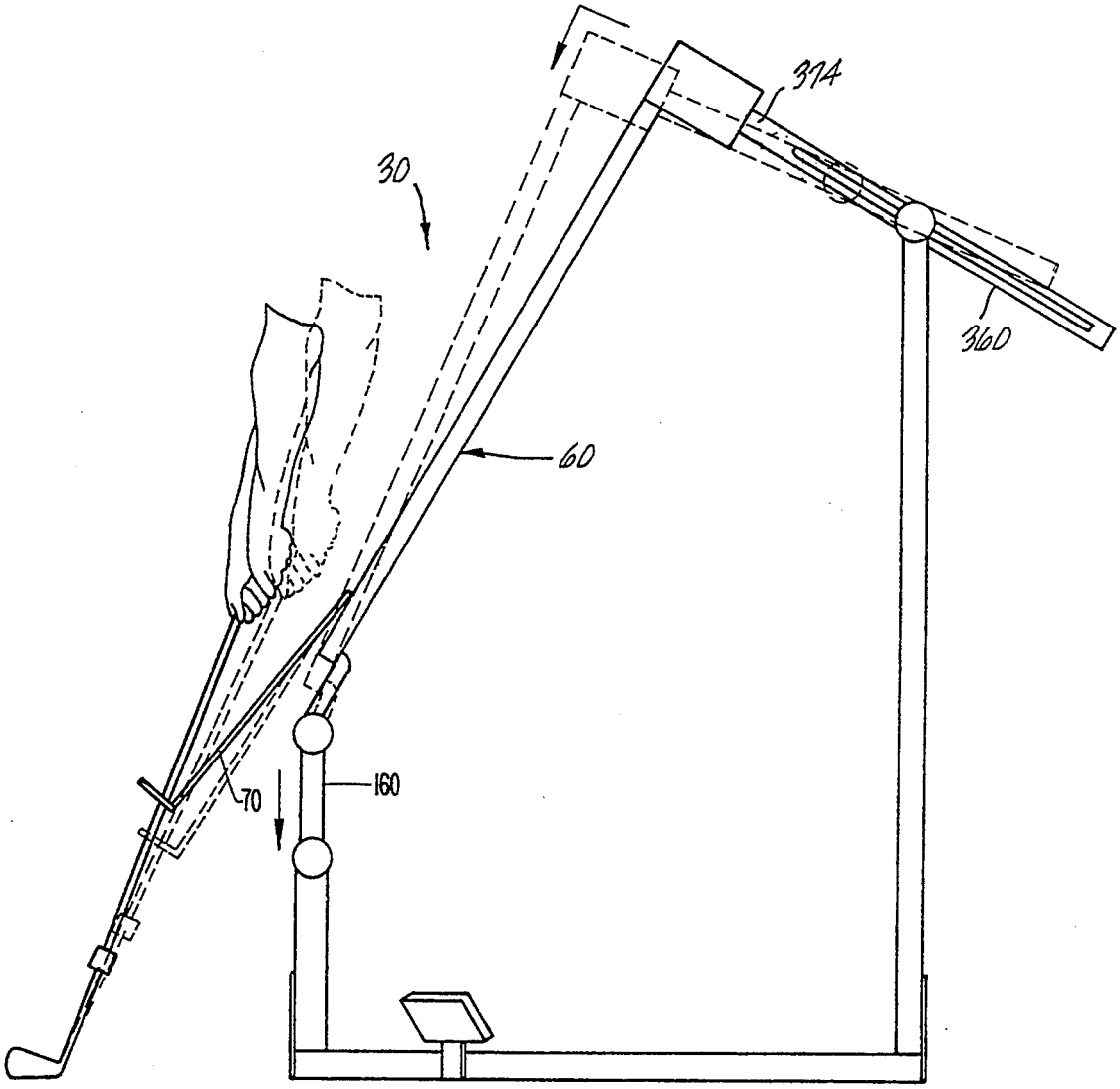
FIG. 16 is a side elevational view of the FIG. 1 embodiment, showing the disposition of the FIG. 5 slidable member, the FIG. 8 elongated member, and the FIG. 9 ring sub-assembly and club-holder assembly, for a first swing plane orientation in which the ring sub-assembly is in a relatively flat plane, and for a second orientation in which the ring sub-assembly is in a relatively upright plane.

In FIG. 16, the solid lines show the device 30 adjusted in a first orientation for a user who has a relatively flat swing plane, i.e., a relatively smaller angle $\propto$ as shown in FIG. 15, and prefers trying to hit the ball along the target line. The proximal portion 374 of the pivotable-slidable member 360 is relatively upright, and the ring sub-assembly 60 parallels the target line.

The dotted lines in FIG. 16 show the device 30 adjusted in a second orientation for a shorter user who also prefers trying to hit the ball along the target line, and who prefers a relatively upright swing plane. Compared to the first orientation, the member 360 is pitched forward and is relatively horizontal, the member 160 is lower, and the clubholder sub-assembly 70 is lower and lies in a more nearly vertical plane.

FIG. 17 shows the ring sub-assembly 60 in a first orientation for a user who prefers to hit the ball along the target line, and in a second orientation for the same user who is trying to perfect a swing which draws the ball. In the second orientation, the ring sub-assembly 60 is slightly rotated clockwise at an azimuth angle $\Psi$ so that the club head moves in an in-to-out swing path relative to the target line during the hitting zone and impact phases.

FIG. 18 shows a right-handed user addressing a ball 580 during the set-up phase, after the height, angle of inclination, and azimuth of the ring sub-assembly have been appropriately set. First, the user positions stop member 316 over the club shaft at region 314, between mid-club and the club head 315. Then the user, while standing on the base sub-assembly 40 with his upper body centered within the ring sub-assembly 60, inserts the shaft 312 of a selected golf club through the opening 300, shown in FIG. 9, determined by the pivotable U-shaped member 280 and the slidable cross-piece member 290, and slides the member 290 on the legs 284 and 286 to reduce the area of opening, 300, but to locate the cross-piece 290 in a position where the club shaft can freely slide and rotate within the opening 300 as the club travels through a full-range of motion swing. The position of the cross-piece member 290 is maintained by tightening the set-screw 293. The user then positions the stop member 316 along the club shaft 312 so that it contacts the members 280 and 290 when the club is posted at the top of the swing and enables proper initiation of the downswing (pulling motion rather than pushing) and initiation of rotation of the ring during the downswing.

A golfer's height is generally the determining factor of his or her swing radius. In general, the taller the person, the larger the swing radius. In the device 30, the swing radius is effectively a lever arm through which the user applies force to the rotatable tubular member 230. The lever arm length is determined by the distance along the club shaft between the user's hands and the U-shaped member 280. Referring again to FIG. 9, the lever arm length and thus the swing radius is adjusted by loosening the set-screw 266 and slidably adjusting the shaft 270 within the housing 260. The shaft 270 is properly positioned within the housing 260 when the clubface contacts the ball when the user is in the address position. Graduated markings may be provided on the shaft 270 to facilitate identification of preferred individual settings.

Figure 19:
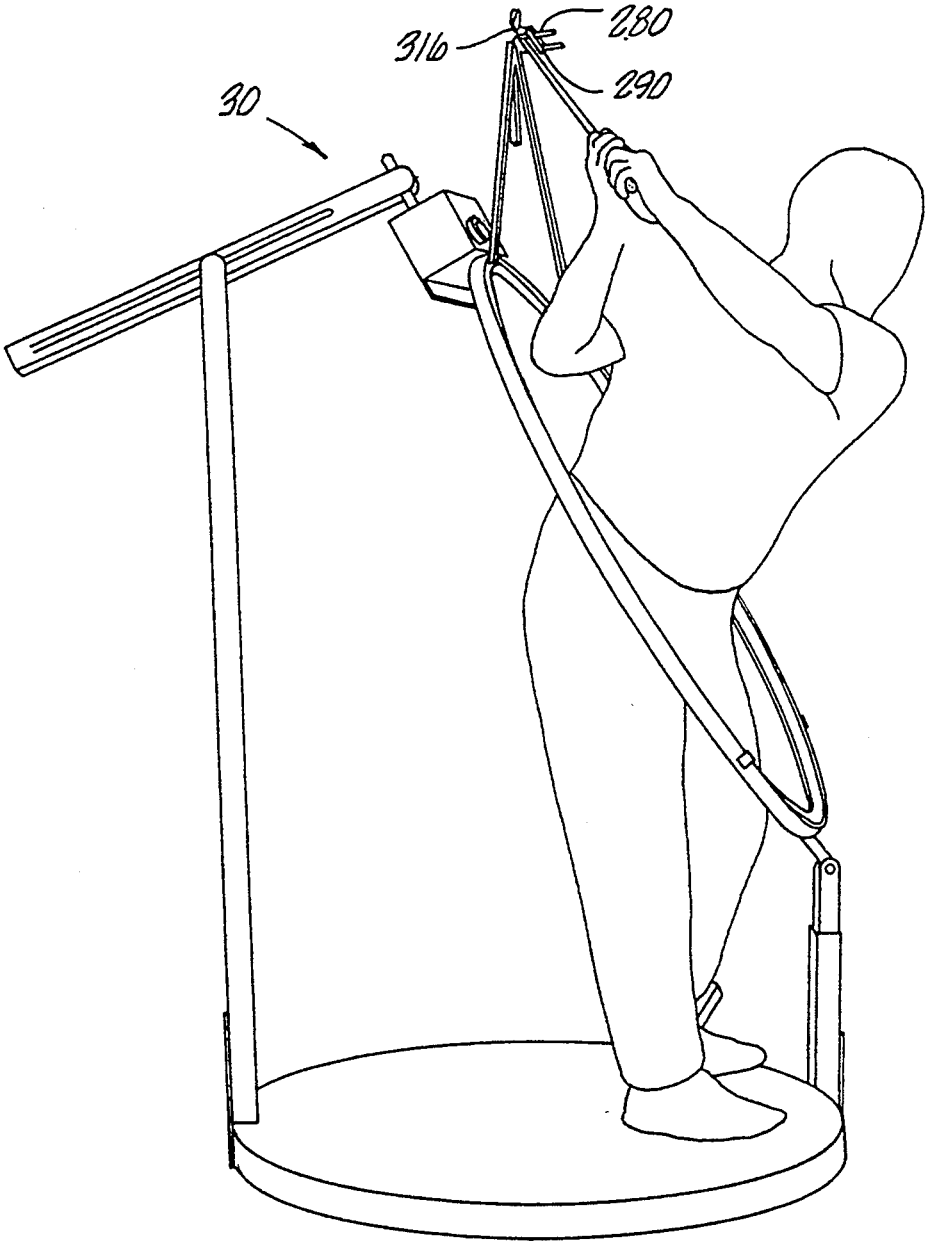
FIG. 19 is a perspective view of the takeaway phase of the full-range of motion swing.

B. General Operation Of The Device In The Context Of An Ideal Eight-Phase Golf Swing Beginning from the set-up phase shown in FIG. 18, the user initiates the takeaway phase, shown in FIG. 19, by rotating the knees, hips, trunk and shoulders as the front arm pushes the back arm back and the front elbow and front arm remain straight. As these body motions are performed, the member 230 freely rotates within the stationary angle member 220 in the backswing direction.

Figure 20:
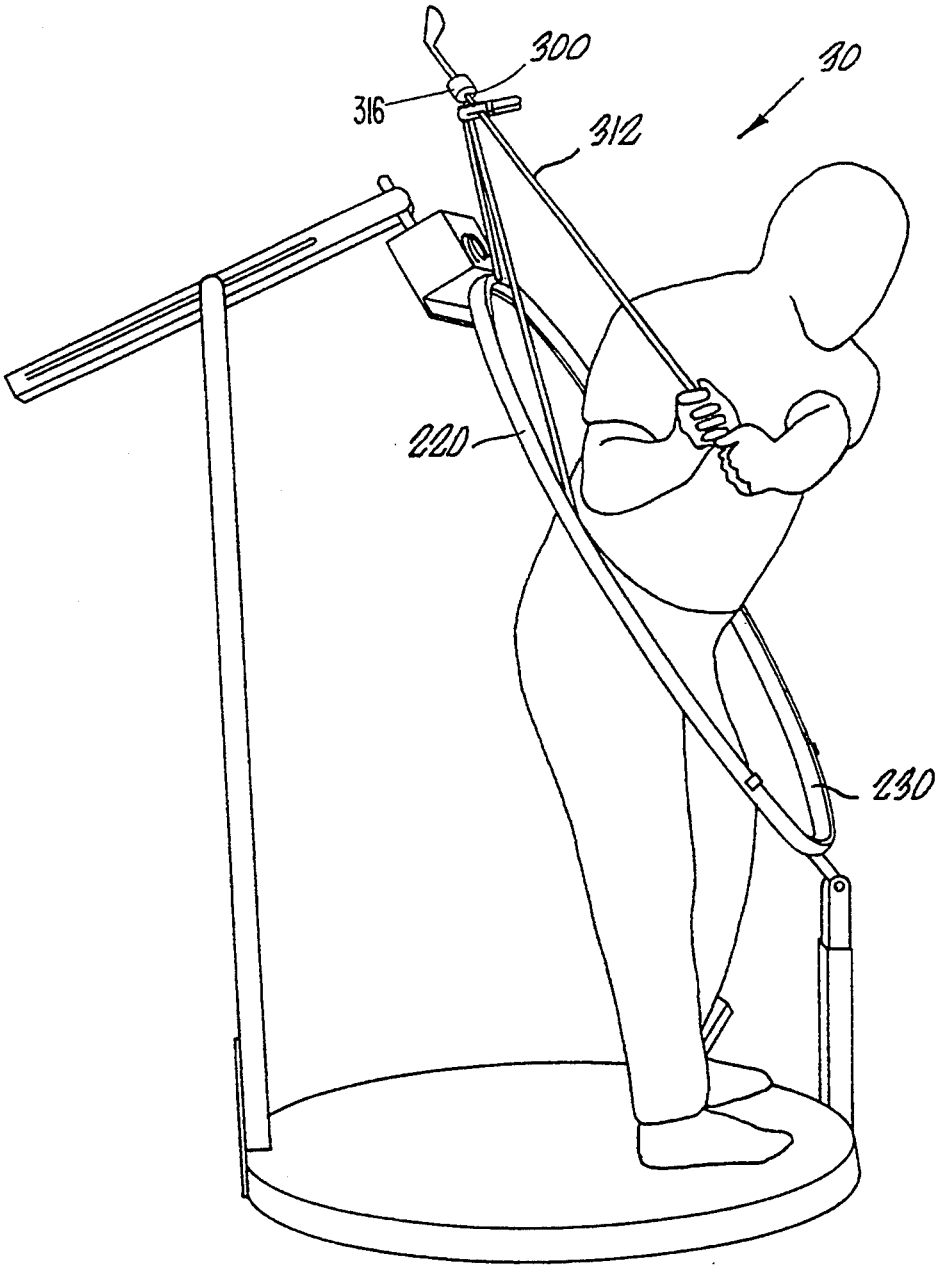
FIG. 20 is a perspective view of the top-of-the-swing phase of the full-range of motion swing.

FIG. 20 shows the top of the swing phase where the shoulders have turned about twice as far as the hips. The front arm has remained straight, the back forearm is now supinated, and the front forearm is now pronated. The stop member 316 is in contact with the U-shaped member 280 and the cross-piece member 290.

Figure 21:
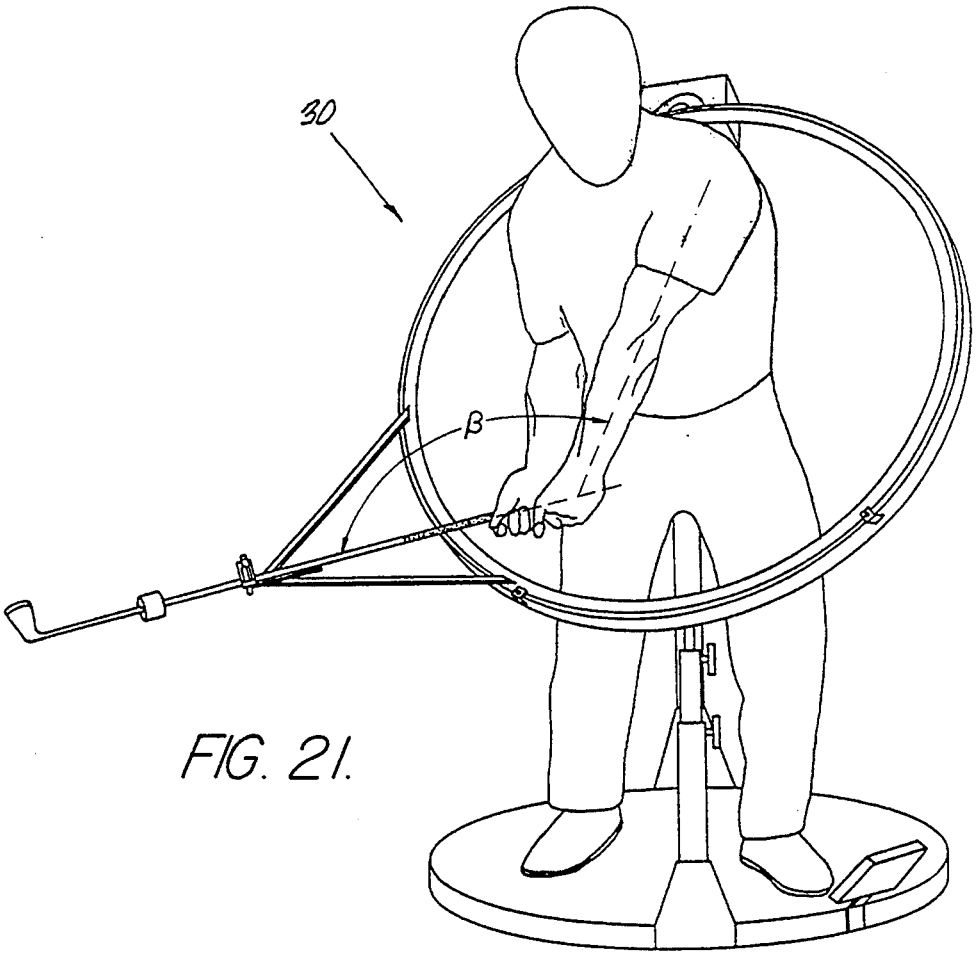
FIG. 21 is a perspective view of the downswing phase of the full-range of motion swing.

FIG. 21 shows initiation of the downswing wherein the club is pulled into action by the unwinding of the body and pulling of the front arm. The force applied to the tubular member 230 through the club shaft 312 causes the member 230 to rotate within the stationary angle member 220 in a direction opposite to its direction of rotation during the backswing. The club head traverses a swing path within the predetermined swing plane. Because the shaft can freely move longitudinally through the opening 300 up to the stop 316, the swing path traverses a non-circular arc.

Figure 22:
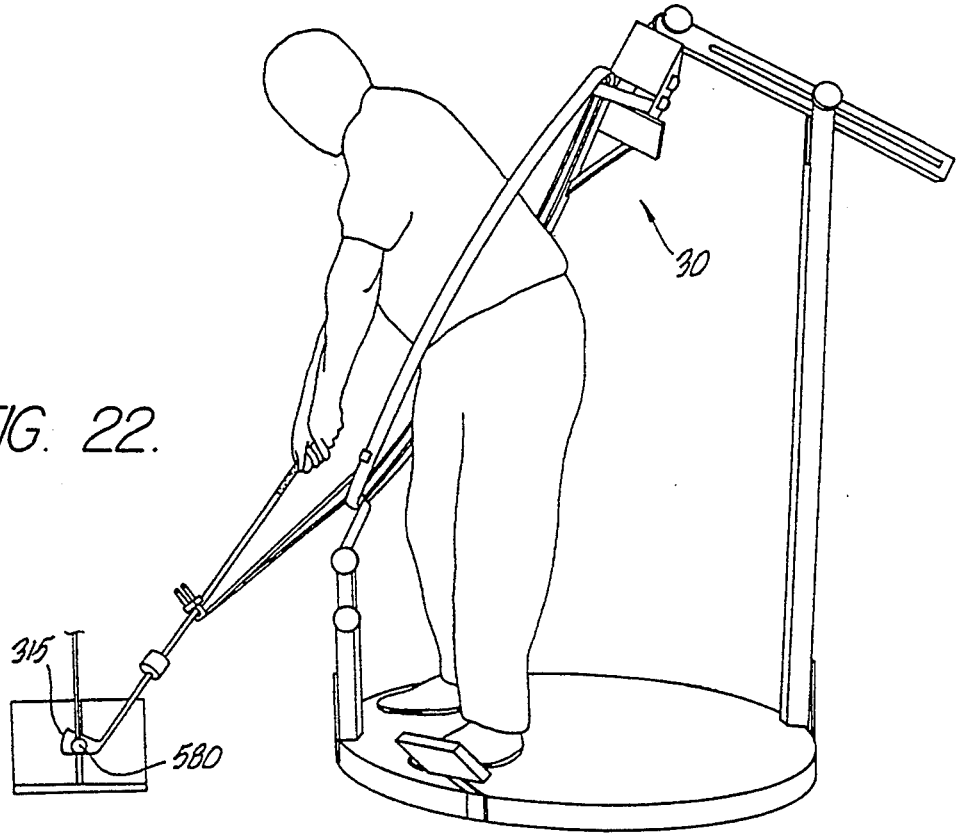
FIG. 22 is a perspective view of the hitting zone phase of the full-range of motion swing.

FIG. 22 shows the hitting zone phase wherein the thrusting legs and hips are forcing the shoulders to turn, thereby accelerating the arms and club. The wrists are about to uncock and the back arm is beginning to straighten.

Figure 23:
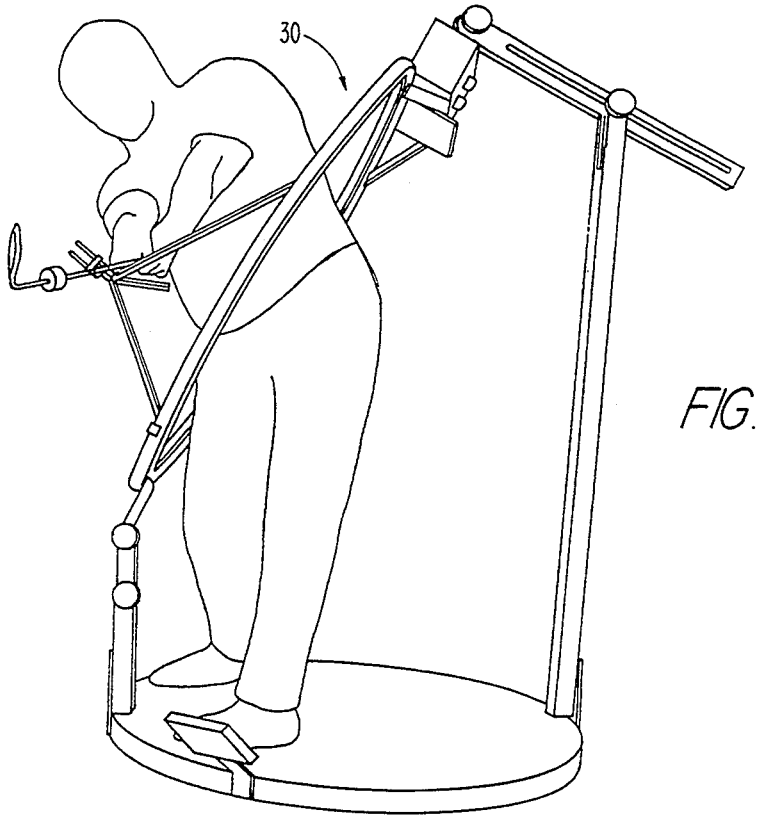
FIG. 23 is a perspective view of the impact phase of the full-range of motion swing.

FIG. 23 shows the impact phase where the arms have returned to their set-up phase position as the club head 315 is swung through the ball 580.

Figure 24:
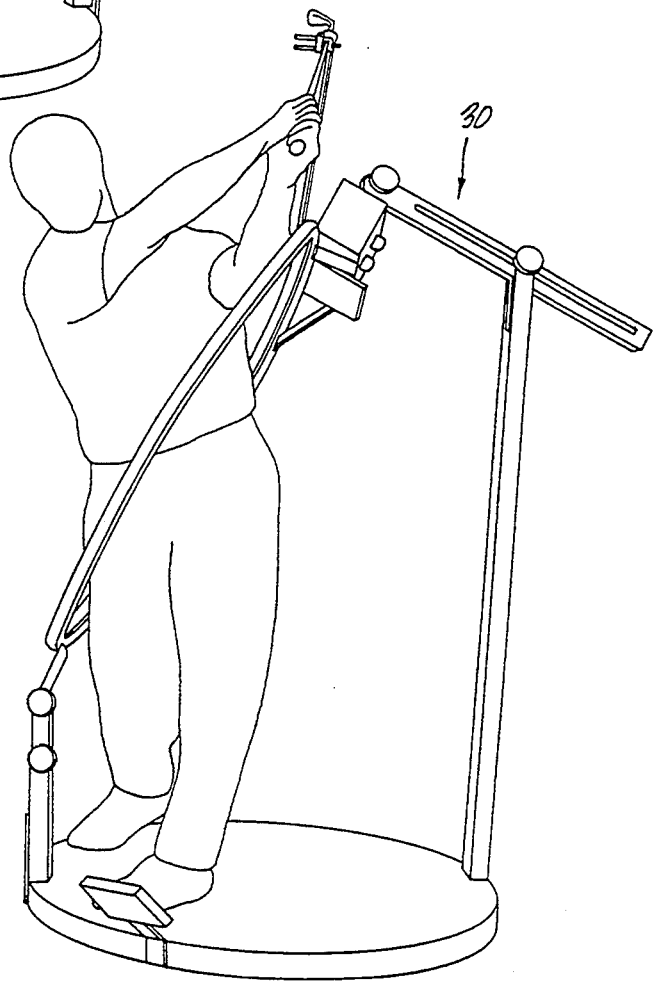
FIG. 24 is a perspective view of the release phase of the full-range of motion swing.

FIG. 24 shows the release phase where the back arm has straightened. The back forearm has pronated and the front forearm has supinated, the forearms being opposite to their rotational position at the top of the swing.

Figure 25:
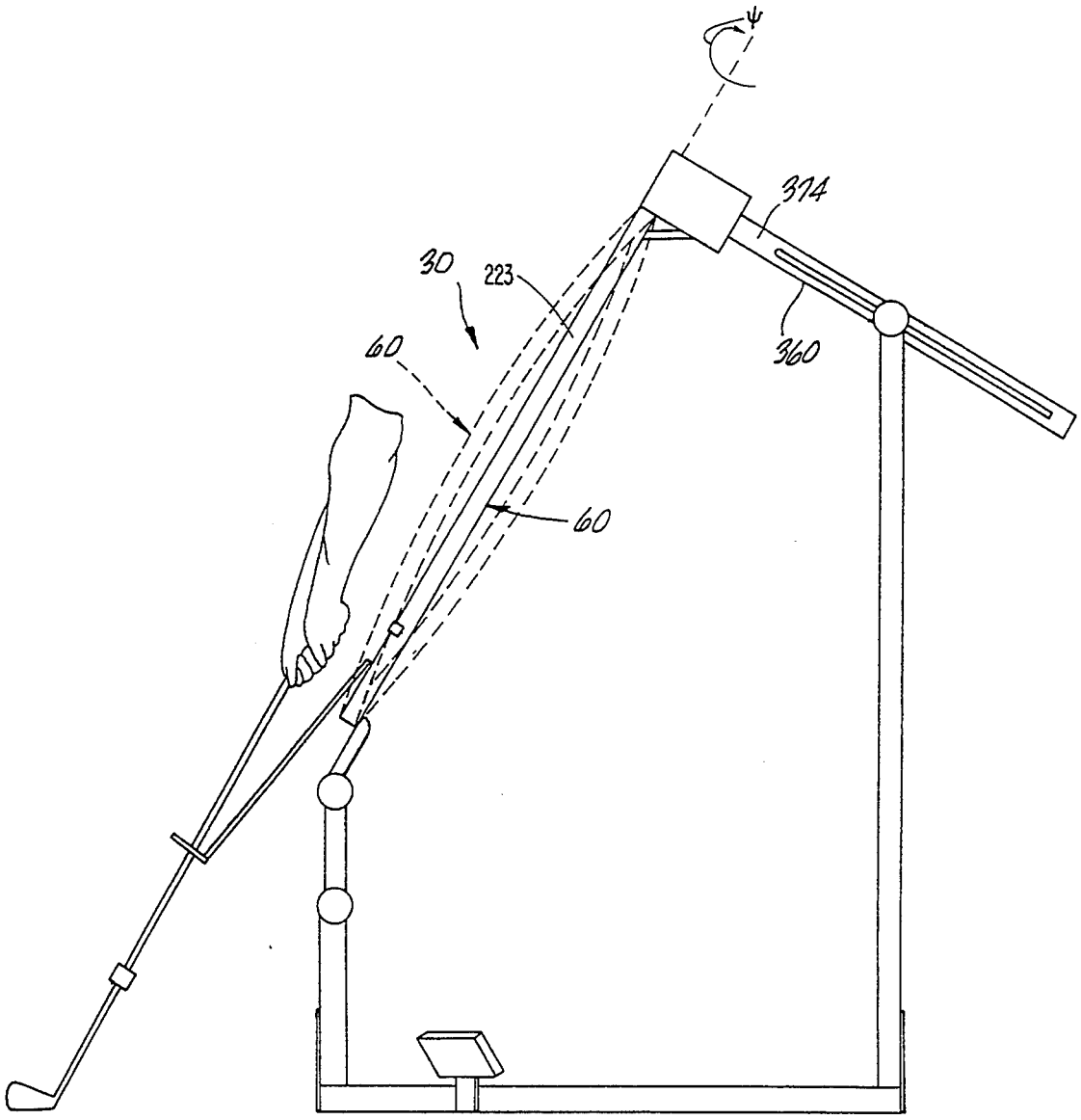
FIG. 25 is a perspective view of the follow-through 5 phase of the full-range of motion swing.
Figure 26:
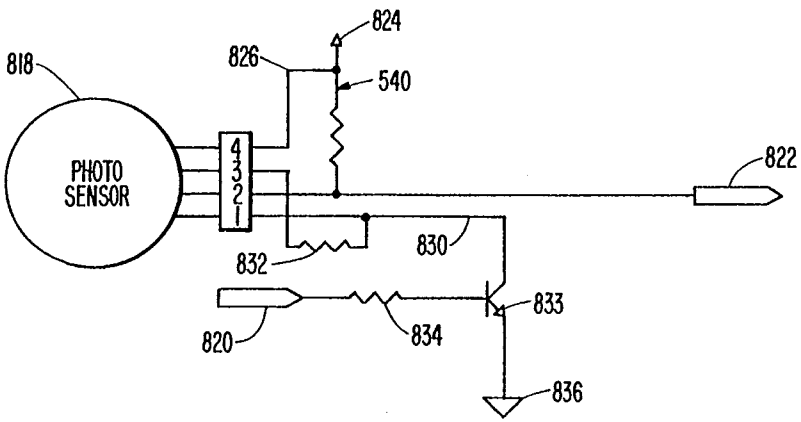
FIG. 26 is a circuit diagram of the displacement sensor of FIG. 13.
Figure 27:
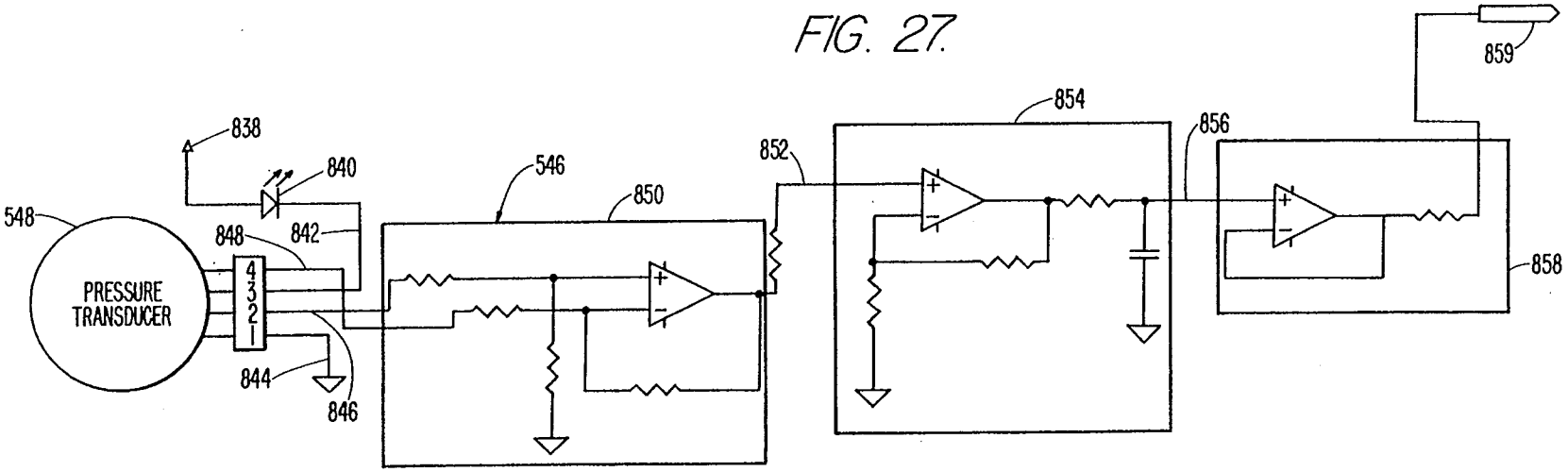
FIG. 27 is a circuit diagram of the pressure sensor of FIG. 13.
Figure 28:
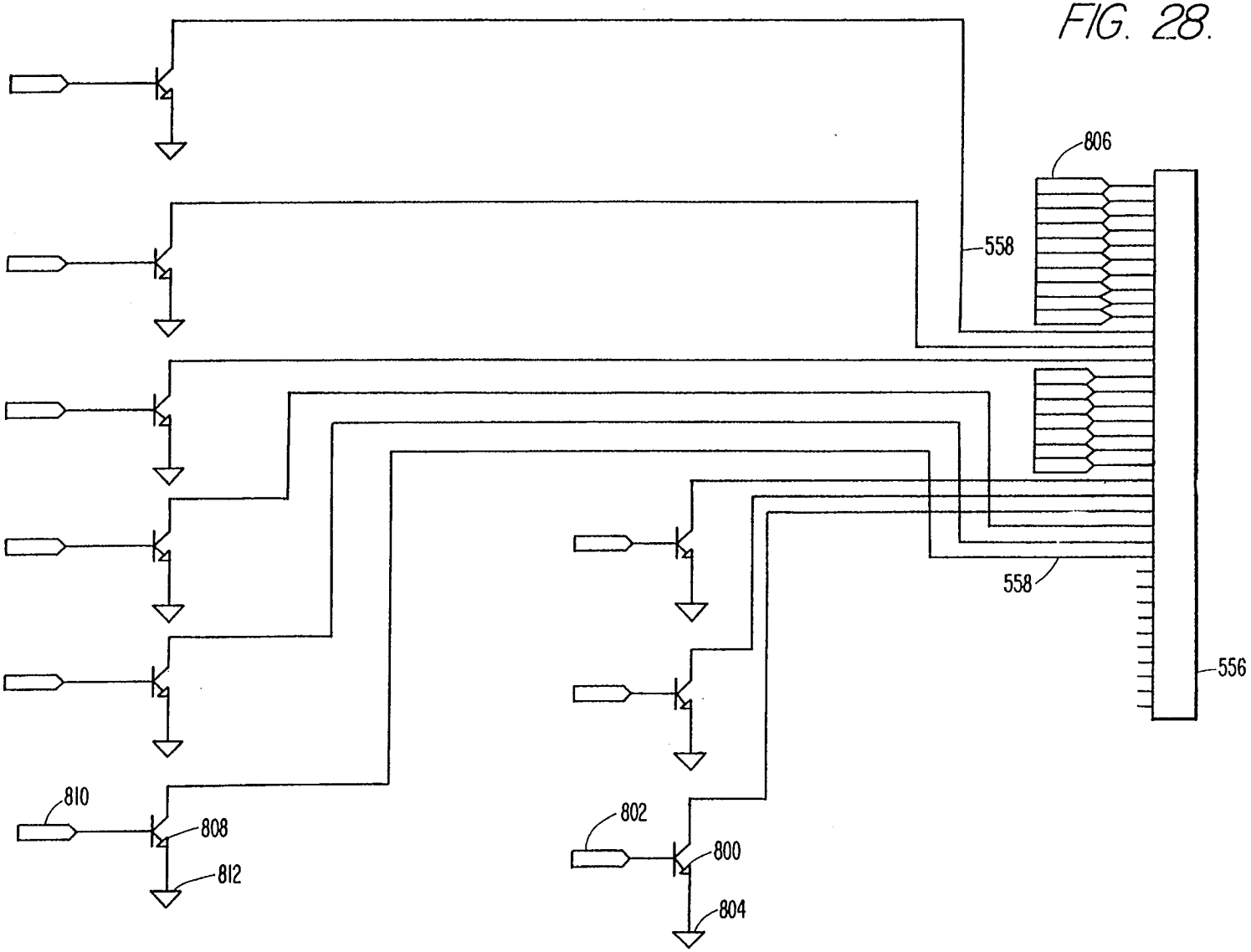
FIG. 28 is a circuit diagram of the addressing latches used in the user interface of FIG. 13.
Figure 29:
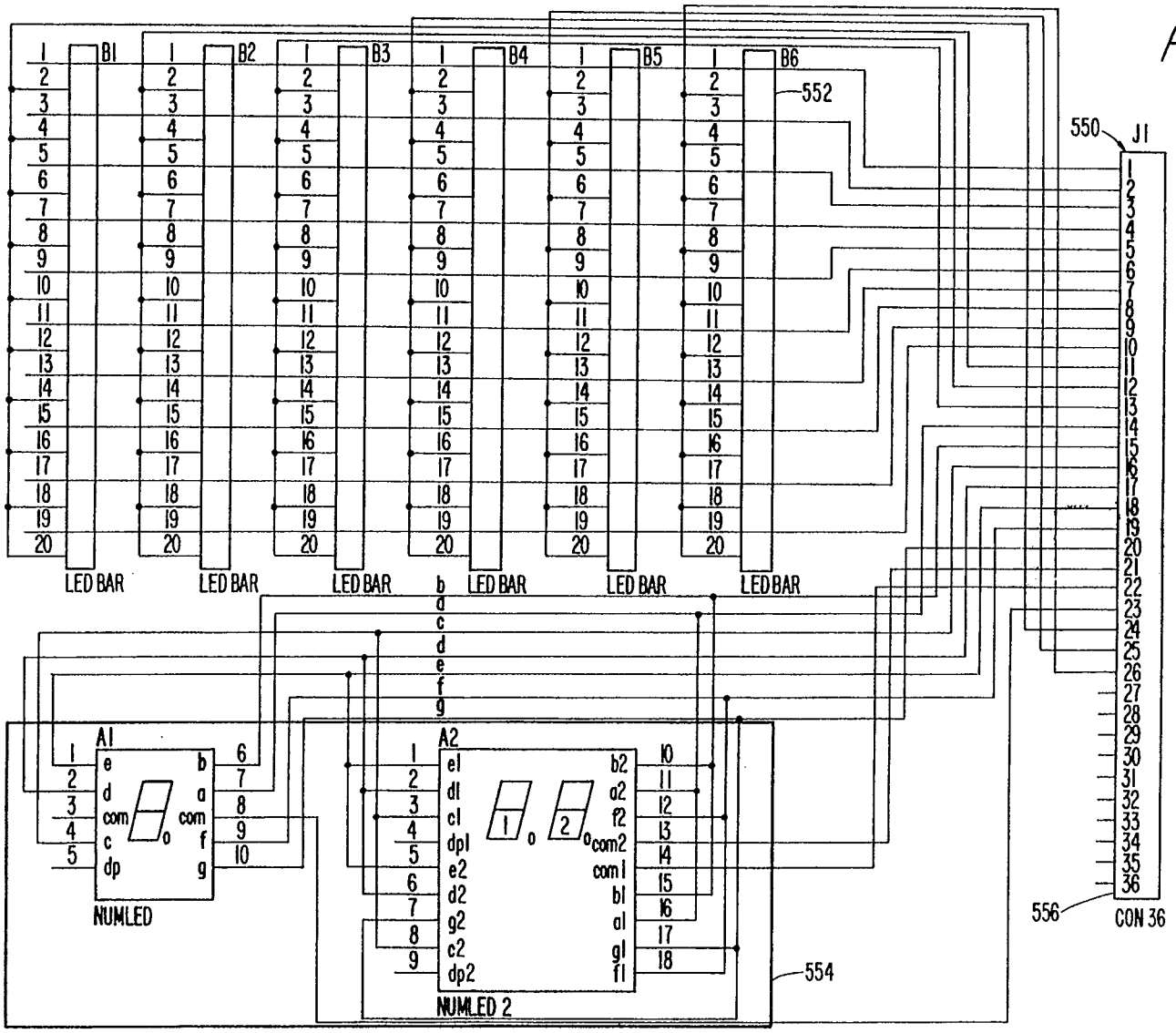
FIG. 29 is a circuit diagram of the display panel of the user interface of FIG. 13.

FIG. 25 shows the follow-through phase where the hips are facing toward the target and the torso has followed the turning of the hips and shoulders.

C. Operation of the Electronic Sub-Assembly

The monitoring controller 544 under the control of the computer program 910 monitors the sensors and displays relevant exercise information on the display screen. The monitoring controller 544 is actuated by the power switch located proximate to the users foot. Before connecting power or resetting the device, the golf club must be positioned in the vertical or zero degree position as though addressing a golf ball. Upon connecting power to the monitoring controller 544, the microprocessor is actuated and the computer program is initiated.

Figure 30:
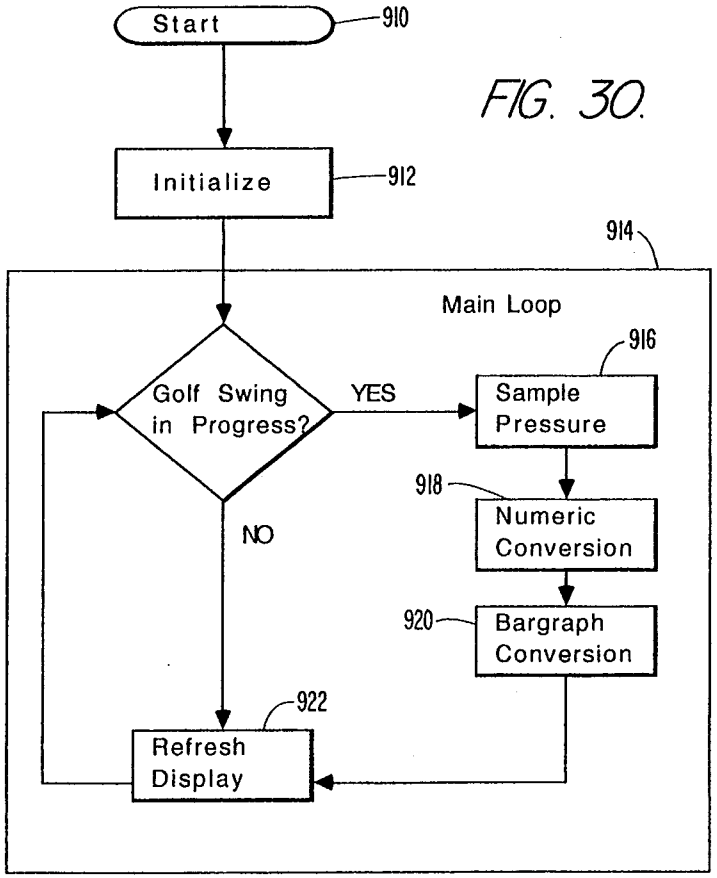
FIG. 30 is a flowchart of the computer program executed by the monitoring controller of FIG. 13.

The computer control program 910 (FIG. 30) includes an initialization routine 912 and main loop 914 including a sample pressure routine 916, a numeric display conversion routine 918, a bar graph display conversion routine 920 and a refresh display routine 922. Once initialized by the initialization routine 912, the program cycles through the main loop 914 where the status of the swing is determined, pressure sampling is conducted and the display is illuminated.

Figure 31:
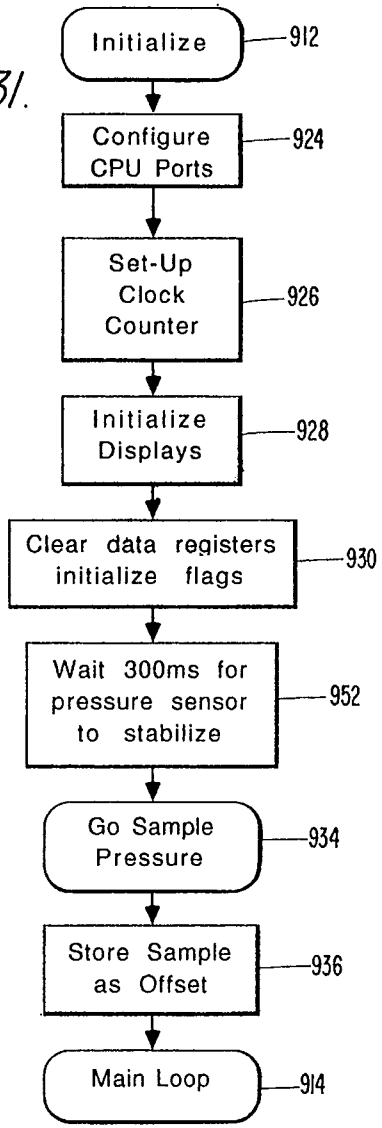
FIG. 31 is a flowchart of the initialize routine of FIG. 30.

The initialize routine 912 (FIG. 31) is performed at start-up when the monitoring controller circuit is first energized or has been reset by the user. The initialize routine 912 includes a port set-up step 924 to set up the port configuration for the microprocessor. An initialize clock step 926 to initialize an 8-bit clock to manage timing for the main loop. A display set-up step 928 blanks out the displays. A clear memory step 930 clears the data registers and flag registers. A delay step 932 pauses the microprocessor for 300 ms to wait for the pressure sensor circuit to stabilize. For a microprocessor running under an 8 MHz clock, this delay requires 5760 clock cycles. A sample pressure subroutine step 934 determines the zero offset value. A store offset value step 936 stores the offset value in the program memory. The main loop 914 is then started.

Figure 32:
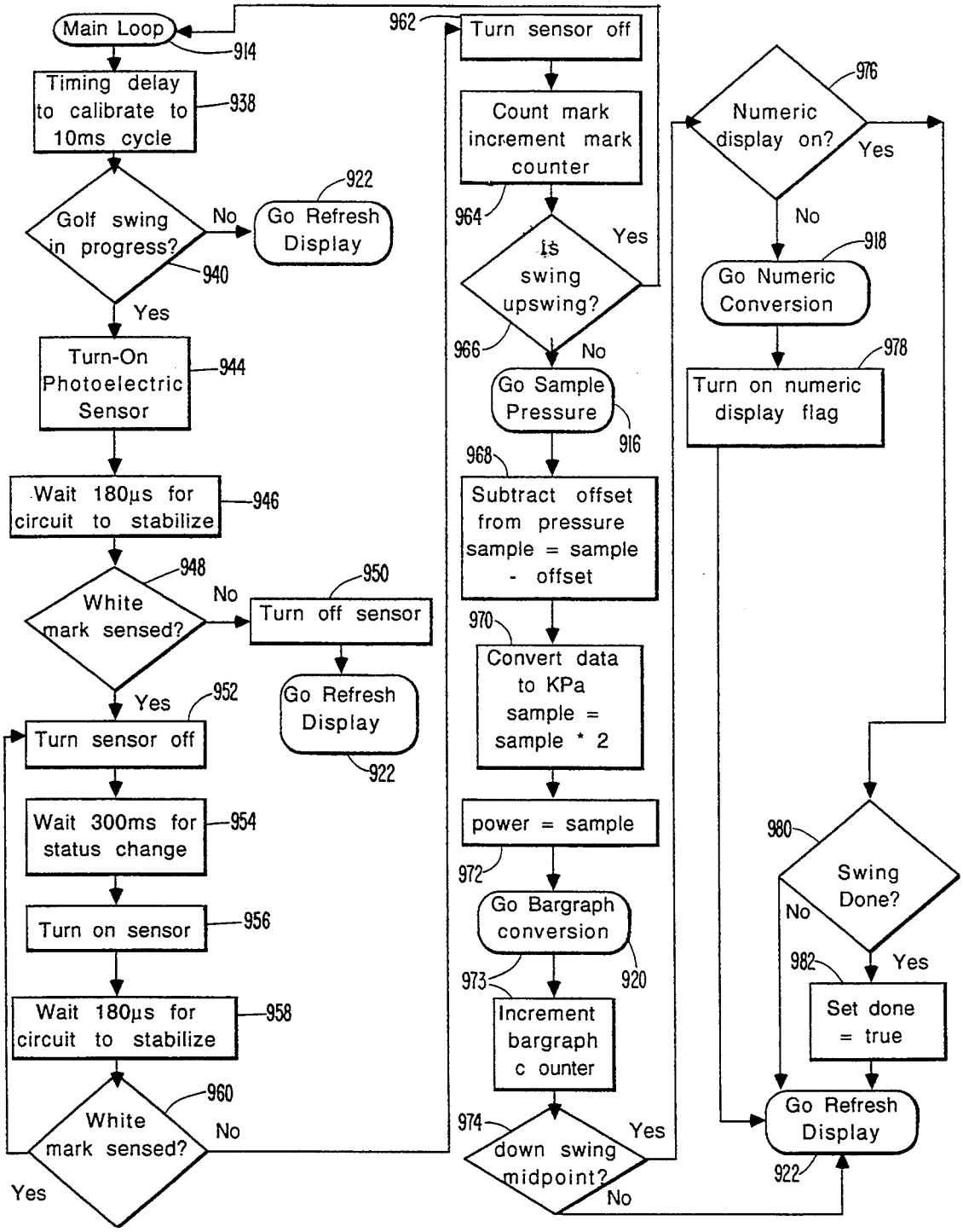
FIG. 32 is a flowchart of the main loop routine of FIG. 30.

The main loop program 914 (FIG. 32) of the preferred embodiment performs two main tasks. First the main loop maintains the illumination of the display. Second the main loop tracks the user's performance through one complete golf swing and displays the user's progress during the down swing.

The main loop includes a clock check step 938 to check and calibrate the timing of each main loop cycle by checking and resetting the clock counter. Next, in a check swing step 940, the status of the golf swing is checked. If the golf swing has been completed, the program merely handles display of the swing results through the display panel in the refresh display 922. Otherwise the status of the golf swing is checked.

In a sensor on step 944, the photoelectric sensor is turned on by placing a load on the sensor enable lead and, in a wait step 946, a delay loop of 180 microseconds is implemented to wait for the sensor to stabilize. The microprocessor then, in find mark step 948, checks the sensor interrupt lead to determine whether a white mark has been read. If not the sensor is turned off, in a turn off sensor step 950 and the refresh display routine 922 is started. Otherwise, the sensor is turned off to conserve power, in a turn off sensor step 952, and a delay of 300 ms is started to wait for the swing to pass through the white mark in a wait step 954. Following the delay, a sensor on step 956 turns on the sensor, a delay of 180 microseconds is performed in a wait step 958 and the sensor interrupt lead bit is checked for the white mark in final mark step 960. If a white mark is still being measured by the sensor then the program loops back to the turn sensor off step 952 and waits for another measurement. Upon completion of the measurement of the displacement sensor, the sensor is again turned off in sensor off step 962 by signalling the sensor enable lead low. The mark counter register is incremented by one to indicate that a white mark was successfully measured in an increment mark counter step 964.

In order to complete and measure one full golf swing through all the intervals while using this program, the user must initialize or start the computer program while the golf club is in the vertical position and the down swing must take the rotatable ring through a 180 degree upswing and a 360 degree downswing. There are six equidistantly placed white marks on the ring. Three of the marks are measured twice, once on the upswing and once on the downswing requiring the monitoring controller to track a total of nine marks during one golf swing. Since the golf swing program assumes the club is addressing the ball position during start-up, the monitoring controller must track the golf swing through an up swing interval before measuring forces applied to the device. During the downswing the force applied to the ball is measured at six equidistant points during the down swing.

In determining the interval of the golf swing, there are three main transition points encompassing the completion of the upswing, the mid-point of the downswing and completion of the downswing. In a check upswing step 966, the program first checks whether an upswing interval is in progress by checking the whether the mark counter is less than or equal to three. If it is in an upswing, the program returns to the beginning of the main loop 914 to check and calibrate timing. Otherwise a downswing motion is assumed and the program initiates the sample pressure routine 916.

Upon completion of the sample pressure routine, the main loop program then calibrates the data for display in an offset step 968. In the preferred embodiment, the pressure offset value is subtracted from the measured pressure and, in a calibrate step 970, the pressure value is multiplied by two to convert the binary value into kilo-pascal (KPa) units. The value is saved as the club pressure value in save step 972. Now, the power value can be converted into a scaled value useable by the bargraph display during the bargraph conversion routine 920.

Following the bargraph conversion, the main loop then checks whether the interval of the golf swing has reached the down swing midpoint in a check midpoint step 974. The midpoint is reach when the mark counter is greater than or equal to seven marks sensed. If not the program goes to the refresh screen routine 922. Otherwise, in a check display step 976, the microprocessor checks the numeric display flag. If the display flag has not been set, the program has determined that the down swing has just reached the midpoint and the determination of the numeric value of the swing force is determined in the numeric conversion routine 918.

Upon return the numeric conversion flag is set on in set flag step 978 and the refresh display routine 922 is accessed. Otherwise, the main loop assumes that the numeric display calculation has already been performed and the program checks whether the downswing has been completed in a check end step 980. If the number of marks counted equals or exceeds nine marks then the program is assumed to have been completed. A completion flag is set on a completed swing step 982 and the refresh display routine 922 is called. Otherwise, the completion flag remains off and the refresh display routine 922 is called.

Figure 33:
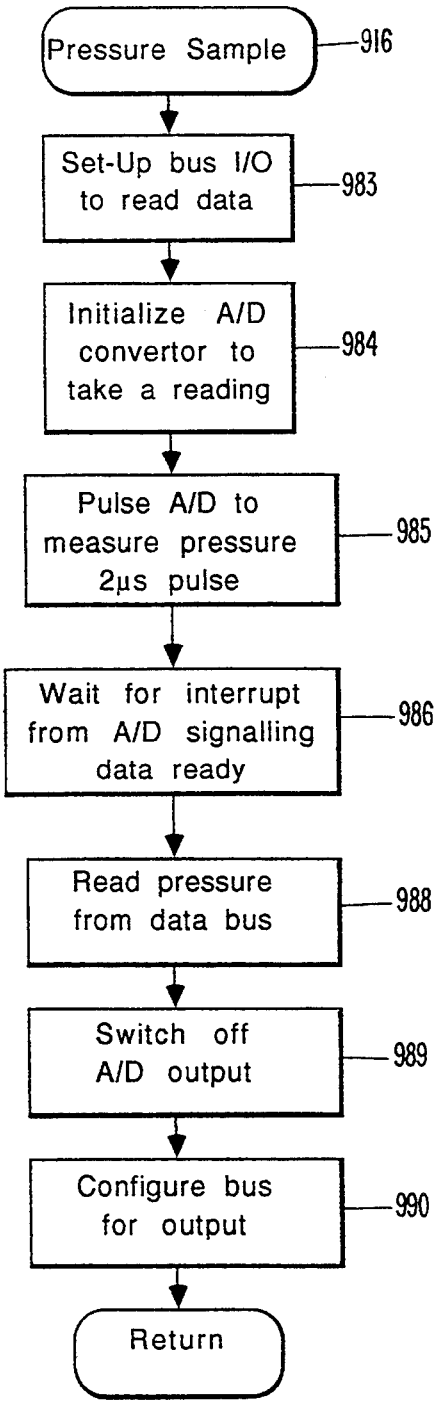
FIG. 33 is a flowchart of the sample pressure routine of FIG. 30.

Referring to FIG. 33, the sample pressure routine 916 requires the microprocessor to set up the data bus to read in data from the A/D convertor in a set-up I/O step 983. The A/D convertor is then initialized to take a reading by signalling a load across a convertor status lead in a set-up converter step 984. In write data step 985, a write pulse is then generated to synchronize the transmission rate of the data across the bus, the microprocessor then waits for the A/D convertor to signal with an interrupt pulse to indicate incoming data in a wait for data step 986. In response to the interrupt pulse, the microprocessor reads in the 8-bits of binary information indicating the level of pressure applied to the pressure transducer in a read data step 988. The microprocessor then switches off the A/D convertor step 989 and reconfigures the bus for data output in a configure bus step 990. Upon completion the pressure sample routine returns to continue the program routine that called it.

Figure 34:
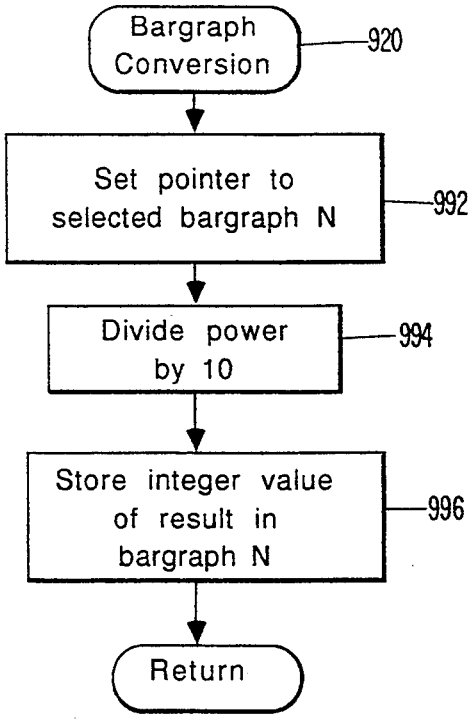
FIG. 34 is a flowchart of the bar graph conversion routine of FIG. 30.

Referring to FIG. 34, the bargraph conversion routine 920 first determines in which bargraph to store the bargraph data in a set pointer step 992. The power value is then divided by ten in a division step 994 and the result is stored as an integer in the data register corresponding to the respective bargraph in an integer store step 996. The routine then returns to the original program routine.

Figure 35:
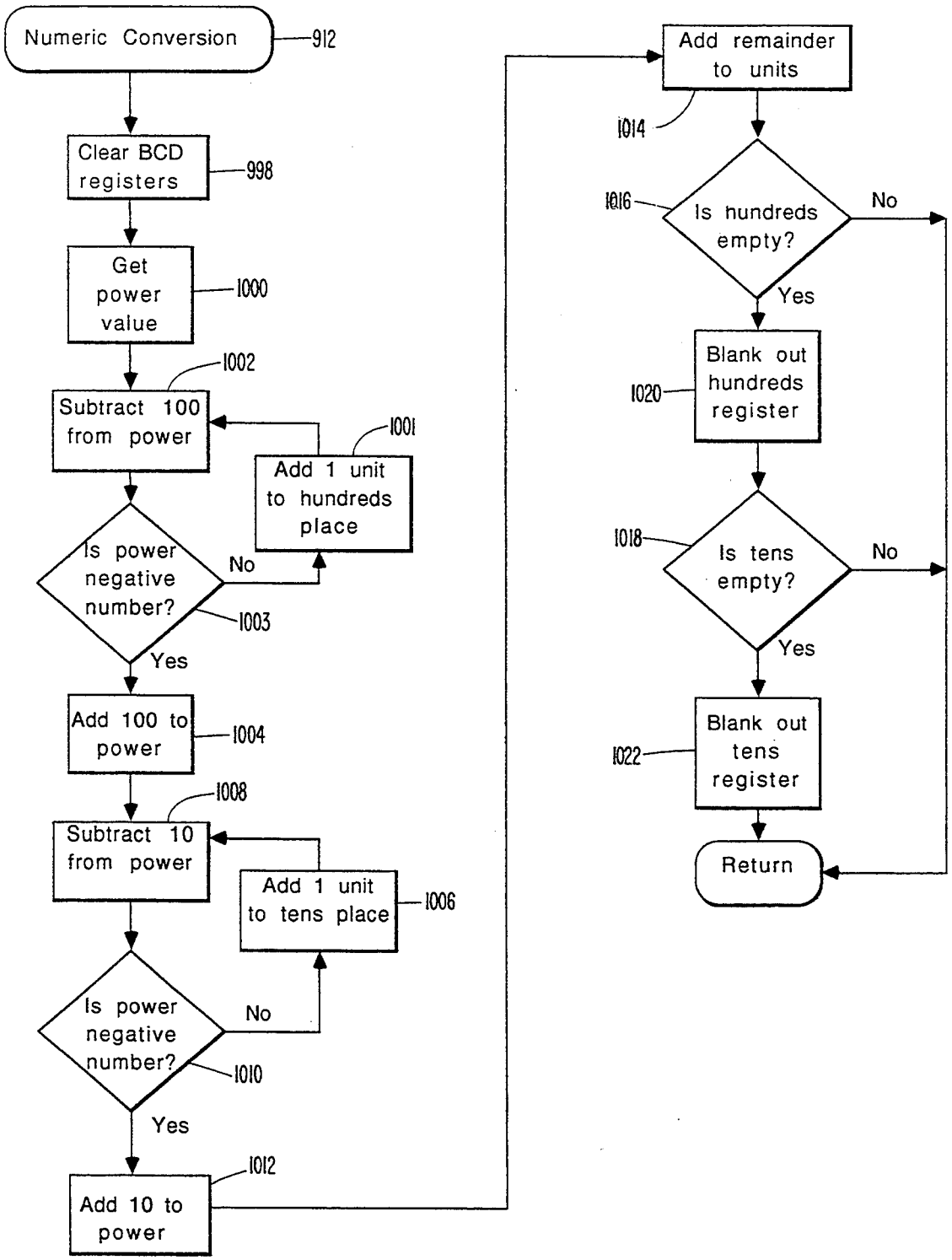
FIG. 35 is a flowchart of the numeric display conversion routine of FIG. 30.
Figure 36:
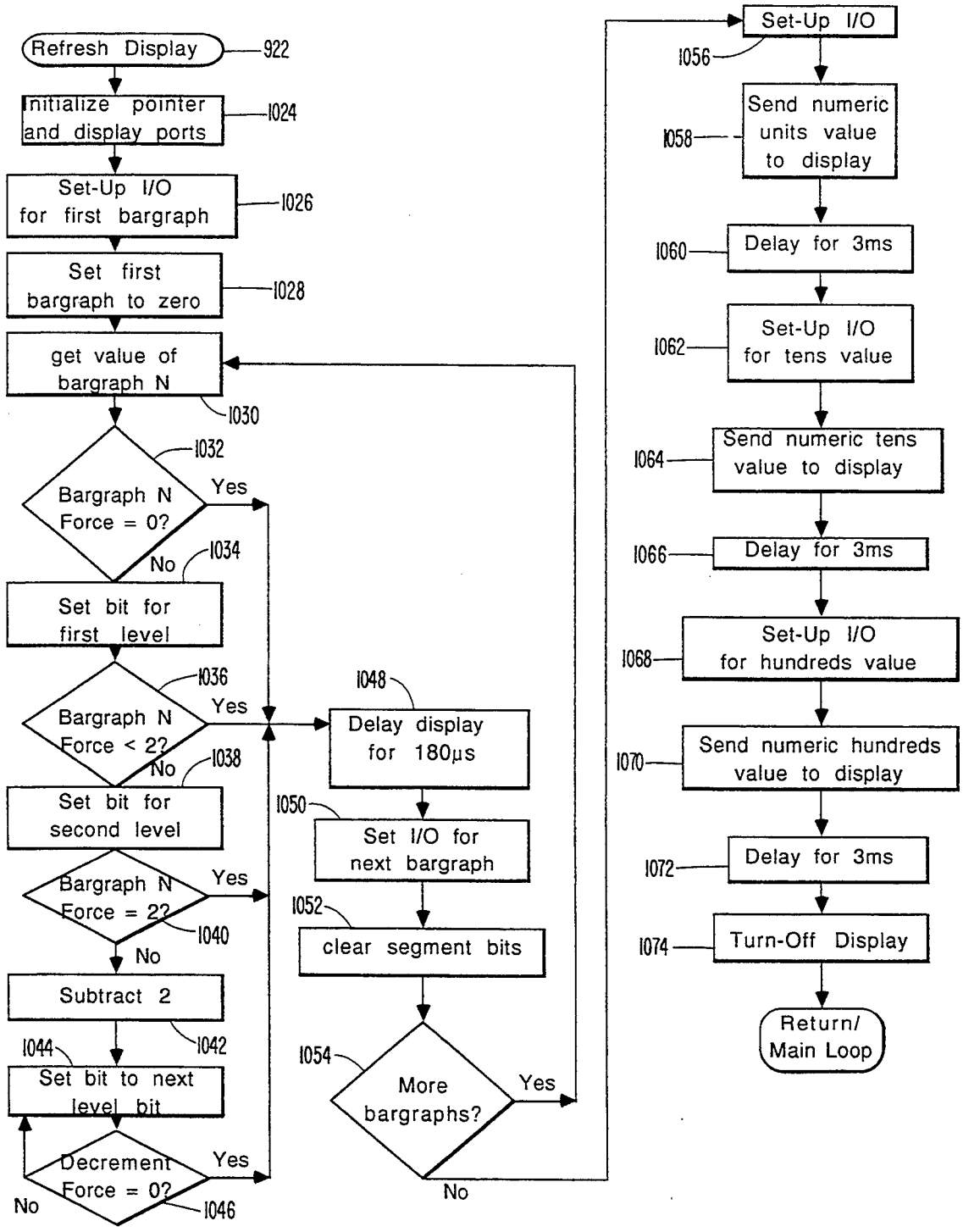
FIG. 36 is a flowchart of the refresh display routine of FIG. 30.

The numeric display conversion routine 912 (FIG. 35) is initiated to convert the power value from binary into a three digit decimal number or binary coded decimal (BCD). First the registers where the numbers will be stored are cleared in a clear BCD step 998 and the pressure value is transferred into a temporary register in a get power step 1000. Then the hundreds place is determined by counting the number of times 1001 the decimal value of 100 can be subtracted from 1002 the pressure value in a "do-while" loop. Each time the pressure value is checked in step 1003 to determine whether it has dropped below zero. If below zero then a hundred is added back to the counter in step 1004 and the last subtraction is not counted. The total number of hundreds counted can then be stored in a BCD hundreds register. Upon completion, the tens place is determined in a similar manner, by counting in step 1006 the number of times the decimal value of 10 can be subtracted from the power value remainder in step 1008. Upon the power value registering as a negative number in step 1010, a value of 10 is added back in step 1012 and the last ten subtracted is not counted. The value of the tens can be stored in the memory and the remainder in the power register is stored in the single units register in step 1014. Finally, the program checks the values of the hundreds and tens place. If the hundreds place in step 1016 or the hundreds place in step 1016 and the tens place in step 1018 register as zero then the respective register values are assigned a number which exceeds the display capabilities of the LED to blank out the display in respective steps 1020 and 1022. Upon completion the program returns to continue the original program loop.

The refresh display routine 922 is called during the program every 10 ms to ensure that the readout on the display does not flicker when viewed by the human eye. The display data registers are configured in sequential address locations to form a data array. The refresh routine initializes the data array pointer and configures the data bus port to send the display information in step 1024. The bus address port first is set up to transmit the address of the first bargraph in step 1026 and the leads of the 8-bit data bus are all set low to blank out the bargraph display in step 1028. Next, the value of the current bargraph is loaded into a temporary register from the first data register in the display array in step 1030. If the bargraph value is zero in step 1032, then the display loop exits to a display hold routine, otherwise a first segment bit is set high in step 1034. If the bargraph value is less than 2 in step 1036, then the program enters the display hold routine, otherwise a second segment bit is set high in step 1038. If the bargraph value is equal to 2 in step 1040, then the program exits to the display hold routine, otherwise the bargraph N value is decremented by 2 in step 1042 and the remaining eight segments of the bar graph are displayed incrementally in step 1044 up to the value stored in the bargraph N by decrementing and testing the value stored in step 1046. Upon illuminating all of the LED segments corresponding to the value stored in the bargraph N register, the display hold routine displays the LED segments for 180 microseconds in step 1048, increments the address pointers for the next bargraph in step 1050, clears the first and second segment bits and the data bus in step 1052 and checks whether all six bargraphs have been displayed in step 1054. If they have not, the program loops back to repeat the display sequence to step 1030. Otherwise, the data bus is cleared and the address port is configured for numeric display of the units value in step 1056. The BCD value stored in the units place is then transmitted over the first 4-bits of the data bus in step 1058 and the program waits for 3 ms to strobe the display value in step 1060. Next, the address port is configured for the tens value in step 1062. The BCD tens value is transmitted in a similar fashion in step 1064 and the program again waits for 3 ms to strobe the tens display in step 1066. Finally, the address I/O is configured for the hundreds value address in step 1068. The data is transferred to the hundreds display in step 1070 and the program strobes the display by waiting for 3 ms in step 1072. Upon completing the display of the numeric values the display ports are all blanked out and turned off in step 1074. Although the bargraphs and the numeric displays are only shown for a fraction of each 10 ms cycle, the display appears to be uninterrupted and continuous to the human eye.

Once the golf swing has been completed in the preferred embodiment, the main loop of the computer program loops continuously through the refresh display routine 922 to provide the user with his last swing results. If another swing is to be measured by the device, then the user must position the golf club in a position to address the ball in a nearly vertical position. Once the club has been positioned, the foot button can be depressed temporarily depriving the electronic sub-assembly of power and thus restarting the computer program stored in the microprocessor of the monitoring controller for another golf swing. It should be noted that this present embodiment is configured to provide the longest possible play time. The high energy displacement sensor is only actuated when a measurement is to be taken and the high energy LED displays are strobed to each illuminate less than $\frac{1}{3}$ of every second. By incorporating low energy steps into the computer program, the number of hours in which the device maybe enjoyed is significantly increased.

In accordance with the broad aspects of the invention, those skilled in the art will appreciate that the speed and capability of the microprocessor can be used to preform several other steps not listed here in the main loop routine. The main loop can be programmed to check for and respond to an interrupt generated by the user interface to switch to different display modes or to perform selected display calculations. For example the bargraphs may be used, upon depressing a mode switch, to provide a summary of the midpoint forces for the last six swings, with the numeric display capable of providing an average, high and low summary of the six swings. Those skilled in the art will appreciate that those types displays are all possible using the present hardware components with the addition of an interrupt switch connected to the free lead on the four bit port of the microprocessor (not shown).

IV. ALTERNATE EMBODIMENTS AND USES

Although the preferred embodiment of the present invention has been adapted for use as a golf swing training device, the invention is not so limited, but rather may be adapted for training and/or exercise in numerous sports swings, such as baseball, softball, tennis, cricket, racketball, squash, paddleball, etc.; as well as in therapeutic exercise of the arms and torso in swinging motions.

Minor sizing adaptations in the vertical support or stanchion sub-assemblies 50 and 80 at the front and rear of the base, or platform sub-assembly 40, respectively, would permit the positioning of the stationary and rotatable ring sub-assembly 60, of the present invention, for ideal strength conditioning and swing training of the baseball swing, the tennis swing, the badminton swing, the handball swing, the javelin throw, the discus throw, the shot put throw or any other upper extremity strength/mobility dominant sport. Minor alterations in the positioning and sizing of the stanchion sub-assemblies 50 and 8 would also permit the positioning of the ring sub-assembly 60 into a more vertical orientation with respect to the base sub-assembly 40 and would render the present invention ideal for strength conditioning and training of the football kick, the soccer kick, or any other lower extremity strength/mobility dominant sport. The club-holder sub-assembly 70 would also than be modified to accommodate a baseball bat, tennis racquet, etc.

Furthermore, such modifications in the present invention would also provide a device ideally suited for the rehabilitation of shoulder or hip joint injuries. The shoulder and hip joints are ball and socket type joints. The positioning and relative fragility of the shoulder joint ligaments permit a larger range of motion (mobility) of the shoulder joint as compared to positioning and density of the hip joint ligaments which limit mobility but provide increased stability of the hip joint. The shoulder joint is therefore susceptible to joint strains, sprains and dislocations, and the hip joint is susceptible to muscle ruptures and bony fractures. Rehabilitation of the ball and socket type joints of the shoulder and hip is best accomplished by a device which permits circumferential resistance training in a specific weakened movement plane and weakened movement path. The ring sub-assembly 60 of the present invention provides circumferential resistance training with isokinetic resistance and is thus ideally suited for the rehabilitation of shoulder and hip joint pathomechanics for five specific reasons: (1) the resistance is delivered throughout the entire joint range of motion; (2) the resistance varies directly with the user's ability to apply his or her maximum force to the rotatable ring 230 thereby permitting the user to self-administer the therapy/sport specific movement safely, avoiding an overstressing of the joint tissues; (3) the joint can be trained in the isolated/-specific plane and path of joint range of motion thereby allowing strength conditioning specific to the identified weakened tissues or specific to the sport-specific movement requirements; (4) the biofeedback provided by the electronic measurements derived from the rotating ring 230 provide the user with self-evaluation of his or her progress either from a sport-specific or rehabilitative aspect; and (5) the device permits the positioning of the actuator ring specific to the user's anatomical requirements and thereby permits the application of the therapy/exercise in the seated, standing or laying postures.

What is claimed is:

1. An exercise device adapted for use by a person, comprising:

a first ring having a predetermined diameter, an inner surface, and an outer surface;

a second ring concentric to the first ring and rotatably retained by the first ring;

means for providing isokinetic resistance to rotation of the second ring;

means for sensing predetermined characteristics of said second ring during rotation and providing sensor signals corresponding to said sensed characteristics;

whereby a person applying a torque in a first direction of rotation causes rotation of the second ring in the first direction of rotation against the isokinetic resistance and said sensing means in response to said rotation senses said predetermined characteristics which are subsequently converted into sensor signals.

2. The exercise device of claim 1, further comprising:

electronic monitor controlling means for receiving said sensor signals, processing said sensor signals, and supplying output signals.

3. The exercise device of claim 2, further comprising:

user interface means responsive to said output signal to provide at least one person with exercise information.

4. The exercise device of claim 3, wherein said user interface includes an electronic display for displaying exercise information in response to said output signals.

5. The exercise device of claim 2, wherein said monitor controlling means includes:

a programmable microprocessor having a memory; and an exercise program, for execution in said microprocessor, for interactively receiving said sensor signals from said sensing means, to thereby track exercise levels of the person rotating said second ring, to thereby generate data corresponding to said exercise levels.

6. The exercise device of claim 3, wherein said user interface includes a sound generator for audibly indicating exercise information in response to said output signals.

7. The exercise device of claim 3, wherein said user interface includes an input means for receiving responses from said person and in response to said responses sending user signals to said monitor controlling means.

8. The exercise device of claim 7, wherein said user interface includes a power switch connecting between the power source and the monitoring controller means to selectively send user signals in the form of power signals to said monitoring controller.

9. The exercise device of claim 7, wherein said user interface includes a button connected between the power source and the monitoring controller means to selectively send user signals in the form of a power interruption to said monitoring controller and said exercise program includes an initialize routine actuated in response to said user signals.

10. The exercise device of claim 1, wherein said sensing means includes:

a displacement sensor for measuring the rotational travel of said second ring during rotation and providing a displacement signal corresponding to a displacement characteristic.

11. The exercise device of claim 1, wherein said sensing means includes:

a pressure sensor for measuring the torque applied by said person during rotation of said second ring and providing a pressure signal corresponding to a pressure characteristic.

12. An exercise device adapted for use by a person, comprising:

a first ring having a predetermined diameter, an inner surface, and an outer surface;

a second ring concentric to the first ring and rotatably retained by the first ring;

means for providing isokinetic resistance to rotation of the second ring;

means for sensing predetermined characteristics of said second ring during rotation and providing sensor signals corresponding to said sensed characteristics;

a microprocessor having a memory;

an exercise program, for execution in said microprocessor, for interactively receiving said sensor signals, to thereby process said sensor signals, and to thereby supply an output signal;

user interface means responsive to said output signal to provide at least one person with exercise information; and whereby a person applying a torque in a first direction of rotation causes rotation of the second ring in the first direction of rotation against the isokinetic resistance and said sensing means in response to said rotation senses said predetermined characteristics which are subsequently converted into sensor signals.

* * * * *